US012577481B1

(12) United States Patent
Webb et al.

(10) Patent No.: US 12,577,481 B1
(45) Date of Patent: Mar. 17, 2026

(54) PROCESSES AND SYSTEMS FOR CONVERSION OF ANIMAL MANURE TO THERMAL GAS AND BIOCHAR

(71) Applicant: W2E Renewable Solutions, Inc., Castle Pines, CO (US)

(72) Inventors: Chris Webb, Englewood, CO (US); Roger Oliver, Castle Rock, CO (US); Daren E. Daugaard, Newburg, MO (US)

(73) Assignee: W2E RENEWABLE SOLUTIONS, INC., Castle Pines, CO (US)

( * ) Notice: Subject to any disclaimer, the term of this patent is extended or adjusted under 35 U.S.C. 154(b) by 0 days.

(21) Appl. No.: 19/370,005

(22) Filed: Oct. 27, 2025

Related U.S. Application Data

(60) Provisional application No. 63/714,956, filed on Nov. 1, 2024.

(51) Int. Cl.
*C10J 3/72* (2006.01)
*C10J 3/06* (2006.01)

(52) U.S. Cl.
CPC ..... *C10J 3/723* (2013.01); *C10J 3/06* (2013.01); *C10J 2300/0906* (2013.01);
(Continued)

(58) Field of Classification Search
CPC ..... C10J 3/06; C10J 2300/0909
See application file for complete search history.

(56) References Cited

U.S. PATENT DOCUMENTS

2012/0104123 A1 5/2012 White et al.
2013/0131196 A1* 5/2013 Cheiky ..... C10J 3/62 518/700

(Continued)

FOREIGN PATENT DOCUMENTS

EP 2565256 A1 3/2013
JP 2018193421 A * 12/2018
KR 20240047011 A * 4/2024 ..... B01J 20/20

OTHER PUBLICATIONS

Matsubara et al. English machine translation of JP 2018193421A. (Year: 2018).*

(Continued)

*Primary Examiner* — Peter F Godenschwager
(74) *Attorney, Agent, or Firm* — O'Connor & Company; Ryan P. O'Connor

(57) ABSTRACT

Processes and systems are disclosed for converting animal manure into useful energy and materials. Some variations provide a process for converting animal manure into a purified thermal gas, comprising: drying a starting animal manure in a manure dryer; pelletizing the dried animal manure to generate manure pellets; thermally reacting the manure pellets in a thermal reactor to generate an intermediate thermal gas and a solid biochar; separating out the solid biochar; condensing the intermediate thermal gas to generate a cooled thermal gas; compressing the cooled thermal gas to generate a compressed thermal gas; catalytically reacting the compressed thermal gas in a water-gas shift reactor to generate a shifted thermal gas having an adjusted $H_2/CO$ ratio; treating the shifted thermal gas using an acid-gas removal unit to generate a purified thermal gas; removing water and/or light gases from the purified thermal gas; and recovering or further processing the purified thermal gas.

30 Claims, 5 Drawing Sheets

(52) U.S. Cl.
CPC ..... *C10J 2300/0909* (2013.01); *C10J 2300/0916* (2013.01); *C10J 2300/0946* (2013.01); *C10J 2300/0986* (2013.01); *C10J 2300/1625* (2013.01)

(56) References Cited

U.S. PATENT DOCUMENTS

| | | | | |
|---|---|---|---|---|
| 2013/0312472 | A1* | 11/2013 | Brehmer | C10B 57/02 71/24 |
| 2017/0197192 | A1 | 7/2017 | Malyala et al. | |
| 2022/0119321 | A1 | 4/2022 | Walker et al. | |
| 2023/0012217 | A1 | 1/2023 | Slack et al. | |

OTHER PUBLICATIONS

English machine translation of Kr 20240047011A. (Year: 2024).*
PCT/US2025/052804 International Search Report and Written Opinion dated Jan. 16, 2026.

* cited by examiner

PROCESSES AND SYSTEMS FOR CONVERSION OF ANIMAL MANURE TO THERMAL GAS AND BIOCHAR

PRIORITY DATA

This patent application is a non-provisional application claiming priority to U.S. Provisional Patent App. No. 63/714,956, filed on Nov. 1, 2024, which is hereby incorporated by reference.

FIELD OF THE INVENTION

The present invention generally relates to processes and systems for converting animal manure into useful materials and energy.

BACKGROUND OF THE INVENTION

Livestock manure, such as cattle manure, is generated in enormous quantities globally. The total amount of livestock manure generated worldwide is over 15 million tons per day on a dry basis. Manure is a valuable source of nutrients for crops and can improve soil productivity. These nutrients primarily include nitrogen, phosphorus, and potassium. However, management of manure and its nutrients poses a significant challenge.

Applying too much manure on an area of land can cause over-fertilization. Land over-fertilization causes the grass to grow excessively and can alter the chemical composition of the grass, producing compounds that can taste bitter or unpalatable to cows. As a result, cows may choose to graze on other areas of the pasture with less-fertilized grass, leading to uneven grazing patterns. Secondary impacts of over-fertilization include algae blooms causing the depletion of oxygen in surface waters, pathogens and nitrates in drinking water, and the emission of odors and gases into the air. Nutrients from excess manure enter lakes and streams through runoff and soil erosion, causing water contamination.

When manure is composted or is anaerobically digested, the microorganisms generate not only carbon dioxide, but also methane and nitrous oxide. Methane has an order of magnitude higher greenhouse-gas potential compared to carbon dioxide, while nitrous oxide has two orders of magnitude higher greenhouse-gas potential compared to carbon dioxide. For these reasons, livestock manure produces over 10% of global greenhouse gas emissions. There is a strong desire to better manage manure to reduce greenhouse gas emissions.

In principle, methane (biogas) can be collected during anaerobic digestion of livestock manure. Anaerobic digestion is a process where the organic matter is broken down in an oxygen-deficient environment, releasing methane, $CO_2$, and solid sludge. Anaerobic digestion is a four-stage process comprising hydrolysis, acidogenesis, acetogenesis, and methanogenesis. Anaerobic digestion of manure poses many challenges. For example, the digestion uses various microorganisms each requiring different temperatures. Creating an environment where all the microorganisms can thrive for optimum biogas production is difficult. Also, animal manure often contains a recalcitrant lignocellulosic component which is difficult to hydrolyze. The unhydrolyzed lignocellulosic component results in incomplete degradation and reduced methane production. Another challenge with anaerobic digestion is that the carbon-to-nitrogen (C:N) ratio has a substantial influence on the process, usually because the substrate is too rich in nitrogen. A low C:N ratio limits most conventional anaerobic digestion processes. Because anaerobic digestion of manure is so challenging, it has been estimated that in the U.S., only 5% of cattle manure is anaerobically digested while 95% is simply spread on land.

On a dry basis, the carbon content of animal manure is typically about 40-45%. This means that fundamentally, animal manure has a stoichiometry that should allow it to be converted to useful energy, fuels, and chemicals. The prior art has not yet provided the appropriate chemical engineering to enable efficient industrial use of animal manure.

In view of the challenges and desires in the art, there is a commercial need for improved processes and systems to convert animal manure (especially cattle manure) into useful energy and materials.

SUMMARY OF THE INVENTION

The present invention addresses the aforementioned needs in the art, by providing various processes and systems to convert manure into useful energy and/or materials.

Some variations provide a process for converting animal manure (e.g., dairy manure) into a purified thermal gas, the process comprising:

(a) providing starting animal manure, wherein the starting animal manure has an average moisture content from about 30 wt % to about 90 wt % $H_2O$;

(b) drying the animal manure in a manure dryer operated at a drying temperature selected from about 50° C. to about 350° C. to generate a dried animal manure, wherein the dried animal manure has an average moisture content from about 15 wt % to about 40 wt % $H_2O$;

(c) pelletizing the dried animal manure in a manure pelletizer to generate manure pellets, wherein the manure pellets have an average moisture content from 0 wt % to about 20 wt % $H_2O$;

(d) thermally reacting the manure pellets in a thermal reactor operated at a reaction temperature selected from about 600° C. to about 1500° C., to generate an intermediate thermal gas and a solid biochar from the manure pellets, wherein the intermediate thermal gas contains at least $H_2$, CO, $CO_2$, $CH_4$, and $H_2O$, and wherein the solid biochar contains at least carbon and ash;

(e) separating the solid biochar from the intermediate thermal gas;

(f) optionally, feeding the intermediate thermal gas to a tar-reforming reactor operated at a tar-reforming temperature selected from about 1200° C. to about 1600° C. or more;

(g) feeding the intermediate thermal gas to a condensing unit, to generate a cooled thermal gas and a separated liquid stream;

(h) compressing the cooled thermal gas using a compression unit, to generate a compressed thermal gas, wherein the compressed thermal gas is at a pressure from about 5 bar to about 55 bar or more;

(i) catalytically reacting the compressed thermal gas in a water-gas shift reactor operated at a water-gas shift temperature selected from about 200° C. to about 550° C., to generate a shifted thermal gas having an adjusted $H_2$/CO ratio compared to a $H_2$/CO ratio of the compressed thermal gas;

(j) treating the shifted thermal gas using an acid-gas removal unit operated to remove at least a portion of carbon dioxide as well as at least a portion of sulfur-containing compounds from the shifted thermal gas, to generate a purified thermal gas;

(k) optionally, removing water and/or light gases from the purified thermal gas; and (l) recovering or further processing the purified thermal gas.

In some embodiments, the starting animal manure has an average moisture content from about 40 wt % to about 60 wt % $H_2O$.

In some embodiments, the dried animal manure has an average moisture content from about 15 wt % to about 25 wt % $H_2O$.

In some embodiments, the drying temperature is selected from about 80° C. to about 200° C.

In some embodiments, the manure pelletizer is selected from the group consisting of a single-screw extruder, a double-screw extruder, a granulation unit, and combinations thereof.

In some embodiments, the manure pellets have an average moisture content from about 5 wt % to about 15 wt % $H_2O$.

In some embodiments, the manure pellets have an average effective length from about 3 millimeters to about 150 millimeters. In some embodiments, the manure pellets have an average effective diameter from about 3 millimeters to about 25 millimeters.

In some embodiments, the reaction temperature is selected from about 700° C. to about 1400° C. In certain embodiments, the reaction temperature is selected from about 800° C. to about 1200° C.

In some embodiments, step (d) includes introducing a sub-stoichiometric quantity of oxygen into the thermal reactor.

In some embodiments, step (d) includes introducing a catalyst into the thermal reactor.

In some embodiments, step (e) includes removing the solid biochar by gravity directly from the thermal reactor.

In some embodiments, step (e) includes removing the solid biochar from the intermediate thermal gas downstream of the thermal reactor.

In some embodiments, step (e) includes using a cyclone and/or an electrostatic precipitator to remove fine particles of the solid biochar from the intermediate thermal gas.

When step (f) is performed, the tar-reforming temperature may be at least 1300° C. Oxygen may be introduced to the tar-reforming reactor, in the form of pure oxygen, air, or oxygen-enriched air. A tar-reforming catalyst may be introduced to the tar-reforming reactor.

In some embodiments, the water-gas shift temperature is selected from about 300° C. to about 450° C. In other embodiments, the water-gas shift temperature is selected from about 200° C. to about 300° C. The water-gas shift reactor may include a high-temperature-shift reaction zone and a low-temperature-shift reaction zone. In these embodiments, the high-temperature-shift reaction zone may be operated at a temperature selected from about 300° C. to about 450° C., and the low-temperature-shift reaction zone may be operated at a temperature selected from about 200° C. to about 300° C.

In some embodiments, the adjusted $H_2$/CO ratio of the shifted thermal gas is selected from about 0.5 to about 5.0. In certain embodiments, the adjusted $H_2$/CO ratio of the shifted thermal gas is selected from about 1.0 to about 3.0 or maximized if targeting $H_2$ production.

In some embodiments, the acid-gas removal unit is selected from the group consisting of a membrane unit, a solvent absorption unit, a scrubber, a refrigeration unit, and combinations thereof.

In some embodiments, the sulfur-containing compounds are selected from the group consisting of $H_2S$, COS, $SO_2$, elemental sulfur, and combinations thereof.

When step (k) is performed, a water knockout unit may be utilized to remove the water from the purified thermal gas. Additionally, or alternatively, a gas-separation unit may be utilized to remove light gases from the purified thermal gas. Light gases may include methane, ethane, propane, ethylene, propylene, and the like.

In some embodiments, the purified thermal gas is recovered and stored or shipped.

In some embodiments, the purified thermal gas is pressurized to a pressure selected from about 10 bar to about 1000 bar. The purified thermal gas may be pressurized for storage, or may be pressurized for feeding to a high-pressure reactor, for example.

In certain embodiments, the purified thermal gas is compressed or cooled to a liquid state.

The purified thermal gas may be further catalytically converted into a product selected from the group consisting of methane, methanol, dimethyl ether, ethanol, diethyl ether, acetic acid, acetaldehyde, ethylene, propylene, Fischer-Tropsch liquids, Fischer-Tropsch waxes, gasoline, diesel fuel, jet fuel, and combinations thereof.

The purified thermal gas may be further catalytically converted into renewable natural gas.

The purified thermal gas may be combusted to produce thermal energy. Alternatively, or additionally, the purified thermal gas may be combusted to produce electrical energy. The purified thermal gas may be lightly compressed before feeding to power generators.

The purified thermal gas may be further processed to produce a hydrogen product.

In some embodiments, the solid biochar is recovered as a biochar co-product. The biochar co-product has a number of potential uses, such as for producing biochar-polymer composite products.

In some embodiments, at least some of the carbon dioxide from step (j) is recovered as a $CO_2$ co-product.

Other variations provide a process for converting animal manure into electricity, the process comprising:

(a) providing starting animal manure, wherein the starting animal manure has an average moisture content from about 30 wt % to about 90 wt % $H_2O$;

(b) drying the animal manure in a manure dryer operated at a drying temperature selected from about 50° C. to about 350° C. to generate a dried animal manure, wherein the dried animal manure has an average moisture content from about 15 wt % to about 40 wt % $H_2O$;

(c) pelletizing the dried animal manure in a manure pelletizer to generate manure pellets, wherein the manure pellets have an average moisture content from 0 wt % to about 20 wt % $H_2O$;

(d) thermally reacting the manure pellets in a thermal reactor operated at a reaction temperature selected from about 600° C. to about 1200° C., to generate an intermediate thermal gas and a solid biochar from the manure pellets, wherein the intermediate thermal gas contains at least $H_2$, CO, $CO_2$, $CH_4$, and $H_2O$, and wherein the solid biochar contains at least carbon and ash;

(e) separating the solid biochar from the intermediate thermal gas;

(f) optionally, feeding the intermediate thermal gas to a tar-reforming reactor operated at a tar-reforming temperature selected from about 1200° C. to about 1600° C.; and (g) feeding the intermediate thermal gas, or a compressed form thereof, to one or more power generators configured to produce electricity.

Other variations provide a process for converting animal manure into thermal energy, the process comprising:

(a) providing starting animal manure, wherein the starting animal manure has an average moisture content from about 30 wt % to about 90 wt % $H_2O$;

(b) drying the animal manure in a manure dryer operated at a drying temperature selected from about 50° C. to about 350° C. to generate a dried animal manure, wherein the dried animal manure has an average moisture content from about 15 wt % to about 40 wt % $H_2O$;

(c) pelletizing the dried animal manure in a manure pelletizer to generate manure pellets, wherein the manure pellets have an average moisture content from 0 wt % to about 20 wt % $H_2O$;

(d) thermally reacting the manure pellets in a thermal reactor operated at a reaction temperature selected from about 600° C. to about 1200° C., to generate an intermediate thermal gas and a solid biochar from the manure pellets, wherein the intermediate thermal gas contains at least $H_2$, CO, $CO_2$, $CH_4$, and $H_2O$, and wherein the solid biochar contains at least carbon and ash;

(e) separating the solid biochar from the intermediate thermal gas;

(f) optionally, feeding the intermediate thermal gas to a tar-reforming reactor operated at a tar-reforming temperature selected from about 1200° C. to about 1600° C.;

(g) feeding the intermediate thermal gas to a condensing unit, to generate a cooled thermal gas and a separated liquid stream;

(h) optionally, compressing the cooled thermal gas using a compression unit, to generate a compressed thermal gas, wherein the compressed thermal gas is at a pressure from about 5 bar to about 55 bar;

(i) treating the cooled thermal gas, or the compressed thermal gas if step (h) is performed, using an acid-gas removal unit operated to remove at least a portion of carbon dioxide as well as at least a portion of sulfur-containing compounds from the shifted thermal gas or the compressed thermal gas, respectively, to generate a purified thermal gas;

(j) optionally, removing water from the purified thermal gas; and (k) feeding the purified thermal gas to one or more combustion units configured to produce thermal energy.

Other variations provide a process for converting animal manure into electricity, the process comprising:

(a) providing starting animal manure, wherein the starting animal manure has an average moisture content from about 30 wt % to about 90 wt % $H_2O$;

(b) drying the animal manure in a manure dryer operated at a drying temperature selected from about 50° C. to about 350° C. to generate a dried animal manure, wherein the dried animal manure has an average moisture content from about 15 wt % to about 40 wt % $H_2O$;

(c) pelletizing the dried animal manure in a manure pelletizer to generate manure pellets, wherein the manure pellets have an average moisture content from 0 wt % to about 20 wt % $H_2O$;

(d) thermally reacting the manure pellets in a thermal reactor operated at a reaction temperature selected from about 600° C. to about 1200° C., to generate an intermediate thermal gas and a solid biochar from the manure pellets, wherein the intermediate thermal gas contains at least $H_2$, CO, $CO_2$, $CH_4$, and $H_2O$, and wherein the solid biochar contains at least carbon and ash;

(e) separating the solid biochar from the intermediate thermal gas;

(f) optionally, feeding the intermediate thermal gas to a tar-reforming reactor operated at a tar-reforming temperature selected from about 1200° C. to about 1600° C.;

(g) feeding the intermediate thermal gas to a condensing unit, to generate a cooled thermal gas and a separated liquid stream;

(h) optionally, compressing the cooled thermal gas using a compression unit, to generate a compressed thermal gas, wherein the compressed thermal gas is at a pressure from about 5 bar to about 55 bar;

(i) treating the cooled thermal gas, or the compressed thermal gas if step (h) is performed, using an acid-gas removal unit operated to remove at least a portion of carbon dioxide as well as at least a portion of sulfur-containing compounds from the shifted thermal gas or the compressed thermal gas, respectively, to generate a purified thermal gas;

(j) optionally, removing water from the purified thermal gas; and (k) feeding the purified thermal gas, or a compressed form thereof, to one or more power generators configured to produce electricity.

Other variations provide a process for converting animal manure into a purified thermal gas, a biochar co-product, and a $CO_2$ co-product, the process comprising:

(a) providing starting animal manure, wherein the starting animal manure has an average moisture content from about 30 wt % to about 90 wt % $H_2O$;

(b) drying the animal manure in a manure dryer operated at a drying temperature selected from about 50° C. to about 350° C. to generate a dried animal manure, wherein the dried animal manure has an average moisture content from about 15 wt % to about 40 wt % $H_2O$;

(c) pelletizing the dried animal manure in a manure pelletizer to generate manure pellets, wherein the manure pellets have an average moisture content from 0 wt % to about 20 wt % $H_2O$;

(d) thermally reacting the manure pellets in a thermal reactor operated at a reaction temperature selected from about 600° C. to about 1200° C., to generate an intermediate thermal gas and a solid biochar from the manure pellets, wherein the intermediate thermal gas contains at least $H_2$, CO, $CO_2$, $CH_4$, and $H_2O$, and wherein the solid biochar contains at least carbon and ash;

(e) separating the solid biochar from the intermediate thermal gas;

(f) optionally, feeding the intermediate thermal gas to a tar-reforming reactor operated at a tar-reforming temperature selected from about 1200° C. to about 1600° C.;

(g) feeding the intermediate thermal gas to a condensing unit, to generate a cooled thermal gas and a separated liquid stream;

(h) compressing the cooled thermal gas using a compression unit, to generate a compressed thermal gas, wherein the compressed thermal gas is at a pressure from about 5 bar to about 55 bar;

(i) catalytically reacting the compressed thermal gas in a water-gas shift reactor operated at a water-gas shift temperature selected from about 200° C. to about 550° C., to generate a shifted thermal gas having an adjusted $H_2/CO$ ratio compared to a $H_2/CO$ ratio of the compressed thermal gas;

(j) treating the shifted thermal gas using an acid-gas removal unit operated to remove at least a portion of carbon dioxide as well as at least a portion of sulfur-containing compounds from the shifted thermal gas, to generate a purified thermal gas;

(k) optionally, removing water and/or light gases from the purified thermal gas;

(l) recovering or further processing the purified thermal gas;

(m) recovering the solid biochar from step (e) as a biochar co-product; and (n) recovering the carbon dioxide from step (j) as a $CO_2$ co-product.

Other variations provide a process for converting animal manure into a hydrogen product, the process comprising:

(a) providing starting animal manure, wherein the starting animal manure has an average moisture content from about 30 wt % to about 90 wt % $H_2O$;

(b) drying the animal manure in a manure dryer operated at a drying temperature selected from about 50° C. to about 350° C. to generate a dried animal manure, wherein the dried animal manure has an average moisture content from about 15 wt % to about 40 wt % $H_2O$;

(c) pelletizing the dried animal manure in a manure pelletizer to generate manure pellets, wherein the manure pellets have an average moisture content from 0 wt % to about 20 wt % $H_2O$;

(d) thermally reacting the manure pellets in a thermal reactor operated at a reaction temperature selected from about 600° C. to about 1200° C., to generate an intermediate thermal gas and a solid biochar from the manure pellets, wherein the intermediate thermal gas contains at least $H_2$, CO, $CO_2$, $CH_4$, and $H_2O$, and wherein the solid biochar contains at least carbon and ash;

(e) separating the solid biochar from the intermediate thermal gas;

(f) optionally, feeding the intermediate thermal gas to a tar-reforming reactor operated at a tar-reforming temperature selected from about 1200° C. to about 1600° C.;

(g) feeding the intermediate thermal gas to a condensing unit, to generate a cooled thermal gas and a separated liquid stream;

(h) compressing the cooled thermal gas using a compression unit, to generate a compressed thermal gas, wherein the compressed thermal gas is at a pressure from about 5 bar to about 55 bar;

(i) catalytically reacting the compressed thermal gas in a water-gas shift reactor operated at a water-gas shift temperature selected from about 200° C. to about 550° C., to generate a shifted thermal gas having a higher $H_2/CO$ ratio compared to a $H_2/CO$ ratio of the compressed thermal gas;

(j) treating the shifted thermal gas using an acid-gas removal unit operated to remove at least a portion of carbon dioxide as well as at least a portion of sulfur-containing compounds from the shifted thermal gas, to generate a purified thermal gas;

(k) optionally, removing water and/or light gases from the purified thermal gas; and (l) recovering the purified thermal gas, or a further-processed form thereof, as a hydrogen product.

Some variations of the invention provide a system configured for converting animal manure into a purified thermal gas, the system comprising:

a manure dryer with a dryer inlet and a dryer outlet, wherein the manure dryer is configured to receive a starting animal manure and to operate at a drying temperature to generate a dried animal manure;

a manure pelletizer with a pelletizer inlet and a pelletizer outlet, wherein the pelletizer inlet is in flow communication with the dryer outlet, and wherein the manure pelletizer is configured to generate manure pellets;

a thermal reactor with a thermal-reactor inlet and a thermal-reactor outlet, wherein the thermal-reactor inlet is in flow communication with the pelletizer outlet, and wherein the thermal reactor is configured to operate at a reaction temperature to generate an intermediate thermal gas and a solid biochar;

optionally, a biochar separation unit in flow communication with the thermal-reactor outlet, wherein the biochar separation unit is configured to remove fine particles of the solid biochar from the intermediate thermal gas;

optionally, a tar-reforming reactor with a tar-reforming reactor inlet and a tar-reforming reactor outlet, wherein the tar-reforming reactor inlet is in flow communication with the thermal-reactor outlet or with the biochar separation unit, if present, and wherein the tar-reforming reactor is configured to operate at a tar-reforming temperature;

a condensing unit with a condenser inlet, a condenser vapor outlet, and a condenser liquid outlet, wherein the condenser inlet is in flow communication with the thermal-reactor outlet or with the biochar separation unit, if present, or with the tar-reforming reactor outlet, if the tar-reforming reactor is present, and wherein the condensing unit is configured to generate a cooled thermal gas and a separated liquid stream;

a compression unit with a compression-unit inlet and a compression-unit outlet, wherein the compression-unit inlet is in flow communication with the condenser vapor outlet, and wherein the compression unit is configured to generate a compressed thermal gas;

a water-gas shift reactor with a WGS reactor inlet and a WGS reactor outlet, wherein the WGS reactor inlet is in flow communication with the compression-unit outlet, and wherein the water-gas shift reactor is configured to catalytically generate a shifted thermal gas having an adjusted $H_2/CO$ ratio compared to a $H_2/CO$ ratio of the compressed thermal gas;

an acid-gas removal unit having an AGRU inlet, an AGRU $CO_2$ outlet, and an AGRU sulfur outlet, wherein the AGRU inlet is in flow communication with the WGS reactor outlet, and wherein the acid-gas removal unit is configured to direct at least a portion of carbon dioxide from the shifted thermal gas to the AGRU $CO_2$ outlet, and to direct at least a portion of sulfur-containing compounds from the shifted thermal gas to the AGRU sulfur outlet, to generate a purified thermal gas;

optionally, a water knockout unit configured to remove water from the purified thermal gas; and optionally, a light-gas separation unit configured to remove light gases from the purified thermal gas.

Other variations provide a system configured for converting animal manure into electricity, the system comprising:

a manure dryer with a dryer inlet and a dryer outlet, wherein the manure dryer is configured to receive a starting animal manure and to operate at a drying temperature to generate a dried animal manure;

a manure pelletizer with a pelletizer inlet and a pelletizer outlet, wherein the pelletizer inlet is in flow communication with the dryer outlet, and wherein the manure pelletizer is configured to generate manure pellets;

a thermal reactor with a thermal-reactor inlet and a thermal-reactor outlet, wherein the thermal-reactor inlet is in flow communication with the pelletizer outlet, and wherein the thermal reactor is configured to operate at a reaction temperature to generate an intermediate thermal gas and a solid biochar;

optionally, a biochar separation unit in flow communication with the thermal-reactor outlet, wherein the biochar separation unit is configured to remove fine particles of the solid biochar from the intermediate thermal gas;

optionally, a tar-reforming reactor with a tar-reforming reactor inlet and a tar-reforming reactor outlet, wherein the tar-reforming reactor inlet is in flow communication with the thermal-reactor outlet or with the biochar separation unit, if present, and wherein the tar-reforming reactor is configured to operate at a tar-reforming temperature; and one or more power generators configured to produce electricity from the intermediate thermal gas.

Other variations provide a system configured for converting animal manure into thermal energy, the system comprising:

a manure dryer with a dryer inlet and a dryer outlet, wherein the manure dryer is configured to receive a starting animal manure and to operate at a drying temperature to generate a dried animal manure;

a manure pelletizer with a pelletizer inlet and a pelletizer outlet, wherein the pelletizer inlet is in flow communication with the dryer outlet, and wherein the manure pelletizer is configured to generate manure pellets;

a thermal reactor with a thermal-reactor inlet and a thermal-reactor outlet, wherein the thermal-reactor inlet is in flow communication with the pelletizer outlet, and wherein the thermal reactor is configured to operate at a reaction temperature to generate an intermediate thermal gas and a solid biochar;

optionally, a biochar separation unit in flow communication with the thermal-reactor outlet, wherein the biochar separation unit is configured to remove fine particles of the solid biochar from the intermediate thermal gas;

optionally, a tar-reforming reactor with a tar-reforming reactor inlet and a tar-reforming reactor outlet, wherein the tar-reforming reactor inlet is in flow communication with the thermal-reactor outlet or with the biochar separation unit, if present, and wherein the tar-reforming reactor is configured to operate at a tar-reforming temperature;

a condensing unit with a condenser inlet, a condenser vapor outlet, and a condenser liquid outlet, wherein the condenser inlet is in flow communication with the thermal-reactor outlet or with the biochar separation unit, if present, or with the tar-reforming reactor outlet, if the tar-reforming reactor is present, and wherein the condensing unit is configured to generate a cooled thermal gas and a separated liquid stream;

optionally, a compression unit with a compression-unit inlet and a compression-unit outlet, wherein the compression-unit inlet is in flow communication with the condenser vapor outlet, and wherein the compression unit is configured to generate a compressed thermal gas;

an acid-gas removal unit having an AGRU inlet, an AGRU $CO_2$ outlet, and an AGRU sulfur outlet, wherein the AGRU inlet is in flow communication with the condenser vapor outlet, or with the compression-unit outlet if the compression unit is present, and wherein the acid-gas removal unit is configured to direct at least a portion of carbon dioxide from the cooled thermal gas or the compressed thermal gas, respectively, to the AGRU $CO_2$ outlet, and to direct at least a portion of sulfur-containing compounds from the cooled thermal gas or the compressed thermal gas, respectively, to the AGRU sulfur outlet, to generate a purified thermal gas;

optionally, a water knockout unit configured to remove water from the purified thermal gas; and one or more combustion units configured to produce thermal energy from the purified thermal gas.

Other variations provide a system configured for converting animal manure into electricity, the system comprising:

a manure dryer with a dryer inlet and a dryer outlet, wherein the manure dryer is configured to receive a starting animal manure and to operate at a drying temperature to generate a dried animal manure;

a manure pelletizer with a pelletizer inlet and a pelletizer outlet, wherein the pelletizer inlet is in flow communication with the dryer outlet, and wherein the manure pelletizer is configured to generate manure pellets;

a thermal reactor with a thermal-reactor inlet and a thermal-reactor outlet, wherein the thermal-reactor inlet is in flow communication with the pelletizer outlet, and wherein the thermal reactor is configured to operate at a reaction temperature to generate an intermediate thermal gas and a solid biochar;

optionally, a biochar separation unit in flow communication with the thermal-reactor outlet, wherein the biochar separation unit is configured to remove fine particles of the solid biochar from the intermediate thermal gas;

optionally, a tar-reforming reactor with a tar-reforming reactor inlet and a tar-reforming reactor outlet, wherein the tar-reforming reactor inlet is in flow communication with the thermal-reactor outlet or with the biochar separation unit, if present, and wherein the tar-reforming reactor is configured to operate at a tar-reforming temperature;

a condensing unit with a condenser inlet, a condenser vapor outlet, and a condenser liquid outlet, wherein the condenser inlet is in flow communication with the thermal-reactor outlet or with the biochar separation unit, if present, or with the tar-reforming reactor outlet, if the tar-reforming reactor is present, and wherein the condensing unit is configured to generate a cooled thermal gas and a separated liquid stream;

optionally, a compression unit with a compression-unit inlet and a compression-unit outlet, wherein the compression-unit inlet is in flow communication with the condenser vapor outlet, and wherein the compression unit is configured to generate a compressed thermal gas;

an acid-gas removal unit having an AGRU inlet, an AGRU $CO_2$ outlet, and an AGRU sulfur outlet, wherein the AGRU inlet is in flow communication with the condenser vapor outlet, or with the compression-unit outlet if the compression unit is present, and wherein the acid-gas removal unit is configured to direct at least a portion of carbon dioxide from the cooled thermal gas or the compressed thermal gas, respectively, to the AGRU $CO_2$ outlet, and to direct at least a portion of sulfur-containing compounds from the cooled thermal gas or the compressed thermal gas, respectively, to the AGRU sulfur outlet, to generate a purified thermal gas;

optionally, a water knockout unit configured to remove water from the purified thermal gas; and one or more power generators configured to produce electricity from the purified thermal gas.

Still other variations provide a system configured for converting animal manure into a hydrogen product, the system comprising:

a manure dryer with a dryer inlet and a dryer outlet, wherein the manure dryer is configured to receive a starting animal manure and to operate at a drying temperature to generate a dried animal manure;

a manure pelletizer with a pelletizer inlet and a pelletizer outlet, wherein the pelletizer inlet is in flow communication with the dryer outlet, and wherein the manure pelletizer is configured to generate manure pellets;

a thermal reactor with a thermal-reactor inlet and a thermal-reactor outlet, wherein the thermal-reactor inlet is in flow communication with the pelletizer outlet, and wherein the thermal reactor is configured to operate at a reaction temperature to generate an intermediate thermal gas and a solid biochar;

optionally, a biochar separation unit in flow communication with the thermal-reactor outlet, wherein the biochar separation unit is configured to remove fine particles of the solid biochar from the intermediate thermal gas;

optionally, a tar-reforming reactor with a tar-reforming reactor inlet and a tar-reforming reactor outlet, wherein the tar-reforming reactor inlet is in flow communication with the thermal-reactor outlet or with the biochar separation unit, if present, and wherein the tar-reforming reactor is configured to operate at a tar-reforming temperature;

a condensing unit with a condenser inlet, a condenser vapor outlet, and a condenser liquid outlet, wherein the condenser inlet is in flow communication with the thermal-reactor outlet or with the biochar separation unit, if present, or with the tar-reforming reactor outlet, if the tar-reforming reactor is present, and wherein the condensing unit is configured to generate a cooled thermal gas and a separated liquid stream;

a compression unit with a compression-unit inlet and a compression-unit outlet, wherein the compression-unit inlet is in flow communication with the condenser vapor outlet, and wherein the compression unit is configured to generate a compressed thermal gas;

a water-gas shift reactor with a WGS reactor inlet and a WGS reactor outlet, wherein the WGS reactor inlet is in flow communication with the compression-unit outlet, and wherein the water-gas shift reactor is configured to catalytically generate a shifted thermal gas having a higher $H_2/CO$ ratio compared to a $H_2/CO$ ratio of the compressed thermal gas;

an acid-gas removal unit having an AGRU inlet, an AGRU $CO_2$ outlet, and an AGRU sulfur outlet, wherein the AGRU inlet is in flow communication with the WGS reactor outlet, and wherein the acid-gas removal unit is configured to direct at least a portion of carbon dioxide from the shifted thermal gas to the AGRU $CO_2$ outlet, and to direct at least a portion of sulfur-containing compounds from the shifted thermal gas to the AGRU sulfur outlet, to generate a purified thermal gas;

optionally, a water knockout unit configured to remove water from the purified thermal gas;

optionally, a light-gas separation unit configured to remove light gases from the purified thermal gas; and a hydrogen-recovery system outlet configured to capture the purified thermal gas as a hydrogen product.

DETAILED DESCRIPTION OF EMBODIMENTS OF THE INVENTION

Figure 1:
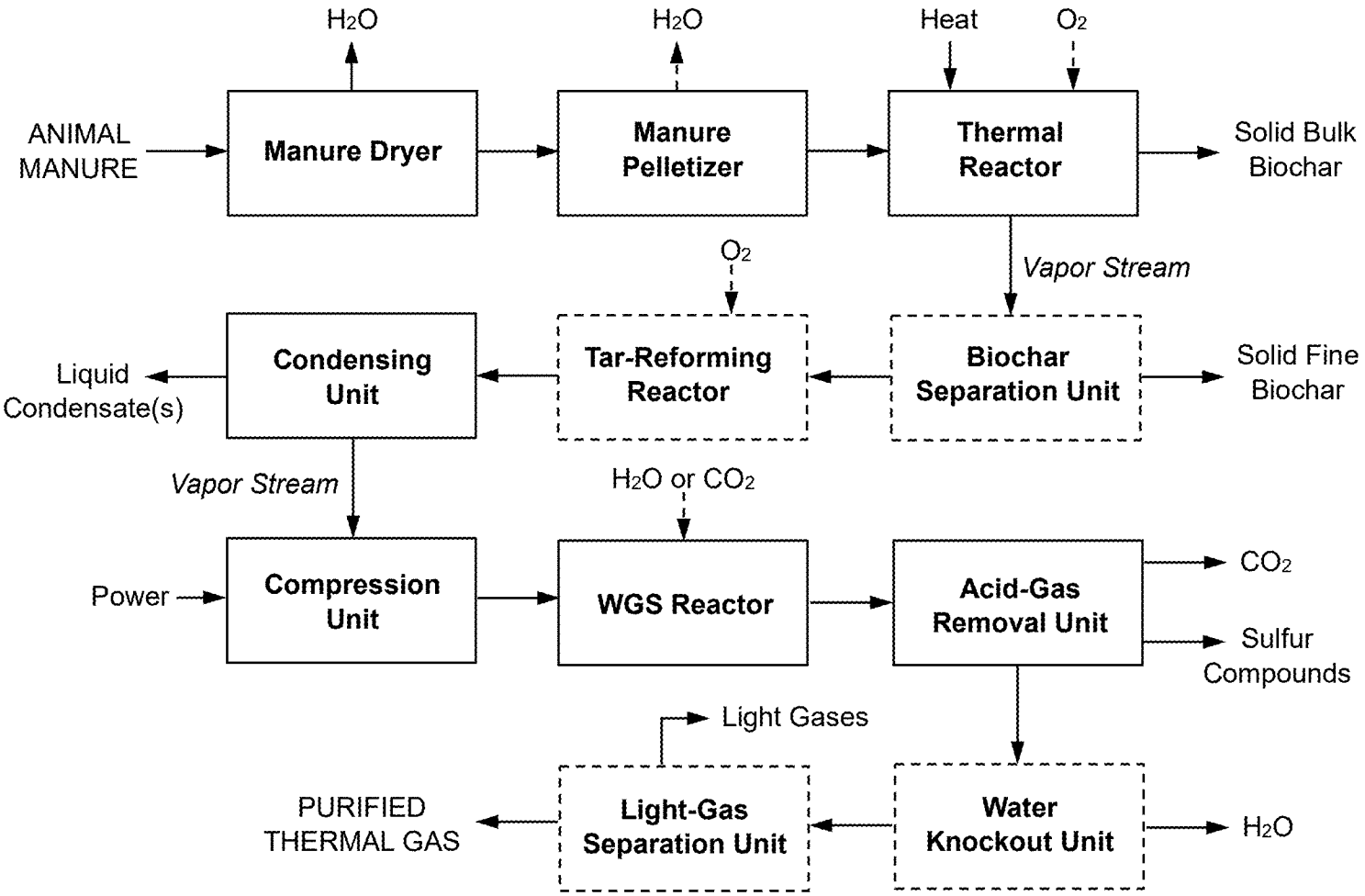
FIG. 1 is an exemplary process block-flow diagram of some embodiments for converting animal manure into purified thermal gas.

This description will enable one skilled in the art to make and use the invention, and it describes several embodiments, adaptations, variations, alternatives, and uses of the invention. These and other embodiments, features, and advantages of the present invention will become more apparent to those skilled in the art when taken with reference to the following detailed description of the invention in conjunction with the accompanying drawings.

As used in this specification and the appended claims, the singular forms "a," "an," and "the" include plural referents unless the context clearly indicates otherwise. Unless defined otherwise, all technical and scientific terms used herein have the same meaning as is commonly understood by one of ordinary skill in the art to which this invention belongs.

Unless otherwise indicated, all numbers expressing reaction conditions, stoichiometries, concentrations of components, and so forth used in the specification and claims are to be understood as being modified in all instances by the term "about." Accordingly, unless indicated to the contrary, the numerical parameters set forth in the following specification and attached claims are approximations that may vary depending at least upon a specific analytical technique.

The phrase "between X and Y" shall be construed as including X and Y as end points, and thus is synonymous with "from X to Y".

The term "comprising," which is synonymous with "including," "containing," or "characterized by" is inclusive or open-ended and does not exclude additional, unrecited elements or method steps. "Comprising" is a term of art used in claim language which means that the named claim elements are essential, but other claim elements may be added and still form a construct within the scope of the claim.

As used herein, the phrase "consisting of" excludes any element, step, or ingredient not specified in the claim. When the phrase "consists of" (or variations thereof) appears in a clause of the body of a claim, rather than immediately following the preamble, it limits only the element set forth in that clause; other elements are not excluded from the claim as a whole. As used herein, the phrase "consisting essentially of" limits the scope of a claim to the specified elements or method steps, plus those that do not materially affect the basis and novel characteristic(s) of the claimed subject matter.

With respect to the terms "comprising," "consisting of," and "consisting essentially of," where one of these three terms is used herein, the presently disclosed and claimed subject matter may include the use of either of the other two terms. Thus in some embodiments not otherwise explicitly recited, any instance of "comprising" may be replaced by "consisting of" or, alternatively, by "consisting essentially of."

For purposes of an enabling technical disclosure, various explanations, hypotheses, theories, speculations, assumptions, and so on are disclosed. The present invention does not rely on any of these being in fact true. None of the explanations, hypotheses, theories, speculations, or assumptions in this detailed description shall be construed to limit the scope of the invention in any way.

The present invention provides processes and systems suitable for converting animal manure, such as cattle manure, into thermal gas. The disclosed processes and systems can efficiently handle normally discarded animal waste. The disclosed processes and systems utilize lower-cost feedstocks compared to most biomass-to-energy technologies.

The disclosed thermolysis process does not require any microorganisms, which means the process is more tolerant than anaerobic digestion. The disclosed thermolysis process is also essentially odorless compared to anaerobic digestion. The disclosed thermolysis process is more efficient than anaerobic digestion in safely directing carbon, hydrogen, oxygen, nitrogen, and sulfur atoms to desirable products rather than being emitted to the environment. The result is that the carbon intensity of the disclosed thermolysis process is substantially lower than the carbon intensity of anaerobic digestion of livestock manure.

Contrary to anaerobic digestion, for which the C:N ratio must be within a certain range for activity of microorganisms, the disclosed thermolysis process does not require any microorganisms. The disclosed thermolysis process is a chemical process, not a biological process. The disclosed thermolysis process leverages livestock (e.g., cattle) essentially as pretreatment reactors, to take in lignocellulosic biomass (e.g., grass or hay) and biologically digest the biomass into manure. The manure-not the starting lignocellulosic biomass-is the feed substrate to the disclosed thermolysis process.

Many revenue streams may be produced using the disclosed processes and systems. Revenue streams may derive from thermal gas, thermal energy, electricity, CO, $H_2$, renewable natural gas, biochar, steam, sulfur compounds, ammonia or other nitrogen compounds, $CO_2$, light fuel gases, methanol, ethanol, acetic acid, dimethyl ether, renewable gasoline, renewable diesel fuel, sustainable aviation fuel, renewable identification numbers, renewable-energy credits, carbon credits, low-emission credits, clean fuel production credits, tax credits, and others co-products.

Reduced emission streams result from the use of the disclosed processes and systems. Reduced emissions include $CO_2$, $CH_4$, nitrous oxides, ammonia, nitrate compounds, sulfur compounds, solid waste, and wastewater, for example. Additionally, a livestock farmer has no solid residual waste to deal with, when utilizing the disclosed processes and systems.

Some variations provide a process for converting animal manure into a purified thermal gas, the process comprising:

(a) providing starting animal manure, wherein the starting animal manure has an average moisture content from about 30 wt % to about 90 wt % $H_2O$;

(b) drying the animal manure in a manure dryer operated at a drying temperature selected from about 50° C. to about 350° C. to generate a dried animal manure, wherein the dried animal manure has an average moisture content from about 15 wt % to about 40 wt % $H_2O$;

(c) pelletizing the dried animal manure in a manure pelletizer to generate manure pellets, wherein the manure pellets have an average moisture content from 0 wt % to about 20 wt % $H_2O$;

(d) thermally reacting the manure pellets in a thermal reactor operated at a reaction temperature selected from about 600° C. to about 1500° C., to generate an intermediate thermal gas and a solid biochar from the manure pellets, wherein the intermediate thermal gas contains at least $H_2$, CO, $CO_2$, $CH_4$, and $H_2O$, and wherein the solid biochar contains at least carbon and ash;

(e) separating the solid biochar from the intermediate thermal gas;

(f) optionally, feeding the intermediate thermal gas to a tar-reforming reactor operated at a tar-reforming temperature selected from about 1200° C. to about 1600° C.;

(g) feeding the intermediate thermal gas to a condensing unit, to generate a cooled thermal gas and a separated liquid stream;

(h) compressing the cooled thermal gas using a compression unit, to generate a compressed thermal gas, wherein the compressed thermal gas is at a pressure from about 5 bar to about 55 bar;

(i) catalytically reacting the compressed thermal gas in a water-gas shift reactor operated at a water-gas shift temperature selected from about 200° C. to about 550° C., to generate a shifted thermal gas having an adjusted $H_2$/CO ratio compared to a $H_2$/CO ratio of the compressed thermal gas;

(j) treating the shifted thermal gas using an acid-gas removal unit operated to remove at least a portion of carbon dioxide as well as at least a portion sulfur-containing compounds from the shifted thermal gas, to generate a purified thermal gas;

(k) optionally, removing water and/or light gases from the purified thermal gas; and (l) recovering or further processing the purified thermal gas.

Manure is primarily derived from the biological excrement from livestock animals, but other substances may be present in the starting manure fed to the process. In this specification, "manure" means livestock waste that is typically a mixture of animal feces and urine, and may also include bedding (e.g., sawdust), feed waste, dirt, and dust, in addition to various quantities of water. Undigested cellulose and lignin may be present in manure. "Animal manure" means the manure generated by an animal, which includes cattle, buffaloes, bison, goats, chickens, pigs, or humans, for example.

In this specification, a "thermal gas" means a gas that contains at least 10 mol % hydrogen and at least 10 mol % carbon monoxide. Other compounds or elements that may be present in thermal gas include, but are not limited to, $CO_2$, $H_2O$, $H_2S$, $CH_4$, $N_2$, Ar, and He.

The intermediate thermal gas may contain at least 10 mol % hydrogen and at least 10 mol % carbon monoxide. In some embodiments, the intermediate thermal gas contains at least 15 mol % hydrogen and at least 15 mol % carbon monoxide. In certain embodiments, the intermediate thermal gas contains at least 20 mol % hydrogen and at least 20 mol % carbon monoxide. Preferably, the intermediate thermal gas contains at least 25 mol % hydrogen and at least 25 mol % carbon monoxide.

The purified thermal gas may contain at least 20 mol % hydrogen and at least 20 mol % carbon monoxide. Preferably, the purified thermal gas contains at least 30 mol % hydrogen and at least 30 mol % carbon monoxide. In some embodiments, the purified thermal gas contains at least 35 mol % hydrogen and at least 35 mol % carbon monoxide.

The purified thermal gas may contain at least 50 mol % of $H_2$ and CO collectively. In some embodiments, the purified thermal gas contains at least 60 mol % of $H_2$ and CO collectively. In certain embodiments, the purified thermal gas contains at least 70 mol % of $H_2$ and CO collectively. In certain preferred embodiments, the purified thermal gas contains at least 80 mol %, at least 85 mol %, or at least 90 mol % of $H_2$ and CO collectively.

In some embodiments targeting $H_2$, the purified thermal gas contains at least 40 mol % hydrogen and at least 25 mol % carbon monoxide. In some embodiments targeting $H_2$, the purified thermal gas contains at least 50 mol % hydrogen and at least 30 mol % carbon monoxide.

Typically, manure drying is followed by manure pelletizing. In principle, if the starting manure has sufficiently high solids content, pelletizing could be done first, then drying. A first amount of drying could be done, then pelletizing, then additional drying of the pellets (prior to the thermal reactor). In certain embodiments, drying and pelletizing are combined, using a dryer-pelletizer apparatus.

In some embodiments, the starting animal manure has an average moisture content from about 40 wt % to about 60 wt % $H_2O$. Note that in certain embodiments, the starting animal manure is present as a relatively dilute slurry, which is why the water concentration can be up to about 90 wt % $H_2O$ in some embodiments. In certain embodiments, the starting animal manure has an average moisture content of about 85 wt % $H_2O$ or more. By "85 wt % or more" it is meant that the water concentration may be about, or at least about, 85 wt %, about 90 wt %, about 95 wt %, or about 99 wt %, for example.

In some embodiments, the dried animal manure has an average moisture content from about 15 wt % to about 25 wt % $H_2O$.

In some embodiments, the drying temperature is selected from about 80° C. to about 200° C. Drying may be carried out in a rotary steam dryer, for example.

In some embodiments, the manure pelletizer is selected from the group consisting of a single-screw extruder, a double-screw extruder, a granulation unit, and combinations thereof.

No binder is necessary for the pelletizing step, since dried manure naturally has sufficient bindability to make the manure pellets. However, if desired, an external binder may be added to the manure pelletizer.

In some embodiments, the manure pellets have an average moisture content from about 5 wt % to about 15 wt % $H_2O$.

In some embodiments, the manure pellets have an average effective length from about 3 millimeters to about 150 millimeters.

In some embodiments, the manure pellets have an average effective diameter from about 3 millimeters to about 25 millimeters.

In some embodiments, the reaction temperature is selected from about 700° C. to about 1400° C. In certain embodiments, the reaction temperature is selected from about 800° C. to about 1200° C. In various embodiments, the reaction temperature is about, at least about, or at most about 600° C., 650° C., 700° C., 750° C., 800° C., 850° C., 900° C., 950° C., 1000° C., 1050° C., 1100° C., 1150° C., 1200° C., 1250° C., 1300° C., 1350° C., 1400° C., 1450° C., or 1500° C., including any intervening range.

The thermal reactor may be operated using a solid-phase residence time selected from about 5 minutes to about 4 hours, such as from about 10 minutes to about 1 hour. In various embodiments, the solid-phase residence time is about, at least about, or at most about 0.05, 0.1, 0.15, 0.2, 0.25, 0.3, 0.35, 0.4, 0.45, 0.5, 0.6, 0.7, 0.8, 0.9, 1, 1.5, 2, 2.5, 3, 3.5, or 4 hours, including any intervening range.

The thermal reactor may be operated at a reactor pressure selected from about 1 bar to about 5 bar. Typically, the reactor pressure is about 1 bar, or the pressure of the local atmosphere (e.g., in Denver, Colorado the atmospheric pressure is about 0.8 bar).

The thermal reactor may use a fixed bed, a moving bed or a fluidized bed. An exemplary thermal reactor is a rotary kiln. Various flow patterns may be utilized in the thermal reactor, such as completed mixed, plug flow, or a hybrid of these two extremes.

The thermal reactor may be indirectly heated by using combustion methane generated within the process, or by using electricity generated from a power generator fed with the thermal gas of the process. Alternatively, or additionally, the thermal reactor may be indirectly heated using combustion of purchased natural gas or other fuels, or by using electricity from the local grid.

Alternatively, or additionally, the thermal reactor may be directly heated by internal combustion, using a sub-stoichiometric amount of oxygen fed to the reactor. In some embodiments, step (d) includes introducing a sub-stoichiometric quantity of oxygen into the thermal reactor. A "sub-stoichiometric quantity of oxygen" means less than 10% of the oxygen required to stoichiometrically fully oxidize all carbon fed to the thermal reactor, preferably less than 5%, more preferably less than 2%, most preferably less than 1% of the stoichiometric combustion amount. Limiting oxygen is important to avoid significant yield loss of thermal gas, since $CO_2$ and $H_2O$ will tend to be generated, rather than CO and $H_2$, when $O_2$ is fed.

In some embodiments, step (d) includes introducing a catalyst into the thermal reactor. The catalyst may be an oxidation catalyst, a tar-cracking catalyst, steam-reforming catalyst, or water-gas shift catalyst, for example. An exemplary catalyst is nickel supported on silica, y-alumina, or zirconia. In preferred embodiments, no external catalyst is added to the thermal reactor, in which case the heat treatment is referred to as "thermolysis". As noted previously, various metal oxides (e.g., $SiO_2$, CaO, $Al_2O_3$, $K_2O$, etc.) that were present in the starting manure may have a catalyst effect on the generation of thermal gas, possibly enhancing the rate and/or selectivity to thermal gas. Whether or not in situ metal oxides cause catalysis, the thermal treatment is still referred to as thermolysis as long as no external catalyst is introduced.

In some embodiments, step (e) includes removing the solid biochar by gravity directly from the thermal reactor. In this configuration, the thermal reactor is equipped with a biochar port that allows solid biochar to flow out of the reactor, either continuously or intermittently (such as with a biochar port valve). Solid biochar removed directly from the thermal reactor is referred to as "bulk biochar".

In certain embodiments, the bulk biochar is not removed from the thermal reactor, but rather is separated from the gas stream in a distinct unit downstream (or sidestream) from the thermal reactor. In FIG. 1, such a distinct unit may be different than the biochar separation unit, which is designed to remove solid fine biochar. For example, a distinct unit may be interposed between the thermal reactor and the biochar separation unit, for removing solid bulk biochar. Alternatively, a common unit may be designed to remove both solid bulk biochar and solid fine biochar as separate output streams.

In some embodiments, step (e) includes removing solid biochar from the intermediate thermal gas downstream of the thermal reactor. Solid biochar removed from the intermediate thermal gas is referred to as "fine biochar", which can be suspended as fine particles (e.g., from 0.1-10 microns in particle size) in the vapor phase. Step (e) may include using a cyclone and/or an electrostatic precipitator to remove fine particles of the solid biochar from the intermediate thermal gas.

The solid fine biochar will have a smaller average particle size compared to the solid bulk biochar. The small particle size is typically the primary reason why that fraction of biochar is entrained in the vapor phase. The density of the solid fine biochar may be the same as, or different than (e.g., lower than) the density of the solid bulk biochar.

It is optional, but preferred, to remove fine biochar from the vapor stream prior to further processing of that stream. In certain embodiments, all or most of the biochar is removed as solid bulk biochar, which leaves little or no fine biochar needing to be removed from the vapor stream.

When both bulk biochar and fine biochar are removed from the process as separate materials, they may remain separate. For example, the bulk biochar may be recovered and sold for a first use (e.g., in asphalt), while the fine biochar may be recovered and sold for a second use (e.g., added to a polymer to make a composite material). Alternatively, the bulk biochar and fine biochar may be combined and then used for a commercial application.

When step (f) is performed, the tar-reforming temperature may be at least 1300° C. Oxygen may be introduced to the tar-reforming reactor, in the form of pure oxygen, air, or oxygen-enriched air. A tar-reforming catalyst may be introduced to the tar-reforming reactor. An exemplary tar-reforming catalyst is rhodium supported on silica, y-alumina, or zirconia.

In some embodiments, the water-gas shift temperature is selected from about 300° C. to about 450° C. In other embodiments, the water-gas shift temperature is selected from about 200° C. to about 300° C. The water-gas shift reactor may include a high-temperature-shift reaction zone and a low-temperature-shift reaction zone. In these embodiments, the high-temperature-shift reaction zone may be operated at a temperature selected from about 300° C. to about 450° C., and the low-temperature-shift reaction zone may be operated at a temperature selected from about 200° C. to about 300° C.

The water-gas shift reactor utilizes a water-gas shift catalyst. Many water-gas shift catalysts are known commercially, including iron oxide, copper oxide, chromium oxide, zinc oxide, alumina, and combinations thereof. When the water-gas shift reactor includes both a high-temperature-shift reaction zone and a low-temperature-shift reaction zone, the high-temperature-shift reaction zone may utilize an iron oxide catalyst with chromium oxide as a promoter, while the low-temperature-shift reaction zone may utilize copper oxide and/or zinc oxide supported on alumina, for example.

In some embodiments, the adjusted $H_2/CO$ ratio of the shifted thermal gas is selected from about 0.5 to about 5.0, or higher when targeting $H_2$. In certain embodiments, the adjusted $H_2/CO$ ratio of the shifted thermal gas is selected from about 1.0 to about 3.0. In certain embodiments, the adjusted $H_2/CO$ ratio of the shifted thermal gas is selected from about 1.5 to about 2.5. In certain embodiments, the adjusted $H_2/CO$ ratio of the shifted thermal gas is selected from about 1.8 to about 2.2. In various embodiments, the adjusted $H_2/CO$ ratio of the shifted thermal gas is selected as about, at least about, or at most about 0.5, 0.6, 0.7, 0.8, 0.9, 1.0, 1.1, 1.2, 1.3, 1.4, 1.5, 1.6, 1.7, 1.8, 1.9, 2.0, 2.1, 2.2, 2.3, 2.4, 2.5, 2.6, 2.7, 2.8, 2.9, 3.0, 3.1, 3.2, 3.3, 3.4, 3.5, 3.6, 3.7, 3.8, 3.9, 4.1, 4.2, 4.3, 4.4, 4.5, 4.6, 4.7, 4.8, 4.9, 5.0, 10, 25, 50, 100, 200, 300, 400, 500, 600, 700, 800, 900, or 1000, including any intervening range (e.g., 1.8-3.3 or 10-500).

In some embodiments, the acid-gas removal unit is selected from the group consisting of a membrane unit, a solvent absorption unit, a scrubber, a refrigeration unit, and combinations thereof. A refrigeration unit may be configured for cryogenic distillation.

Amine-based units are known for removing $CO_2$ and $H_2S$ from gas streams. In such systems, the amine functions as a solvent to dissolve $CO_2$, which is later removed by adjusting conditions such as temperature. Any amine may be utilized as the solvent, such as diethanolamine (DEA), monoethanolamine (MEA), methyldiethanolamine (MDEA), diisopropanolamine (DIPA), or aminoethoxyethanol (DGA). Water washing is commonly used to remove $CO_2$ in gas cleanup systems.

Cryogenic separation (or cryogenic distillation) may be used for the separation of $CH_4$, $CO_2$, $N_2$, and/or other components, from a thermal gas stream. Components of the thermal gas are separated using differences in their boiling points. The thermal gas may be pretreated to remove any impurities that would freeze at cryogenic temperatures, primarily water and carbon dioxide, and methane at cold enough temperatures.

In some embodiments, the sulfur-containing compounds (removed by the acid-gas removal unit) are selected from the group consisting of $H_2S$, COS, $SO_2$, elemental sulfur, and combinations thereof.

Optionally, an additional reactor, such as a hydrolysis reactor, may be used to treat the gas stream prior to entering the WGS reactor, or the gas stream exiting the WGS reactor. For example, a hydrolysis reactor may be configured to hydrolyze certain sulfur-containing compounds, such as COS, to produce $CO_2$ and $H_2S$ according to the reaction $$COS+H_2O \rightarrow CO_2+H_2S$$

which may be catalyzed by activated alumina, for example. Alternatively, or additionally, the hydrolysis reactor (or a separate hydrolysis reactor) may be configured to hydrolyze certain nitrogen-containing compounds, such as HCN, to produce $NH_3$, $N_2O$, $N_2$, $CO_2$, and/or $CH_2O_2$.

When step (k) is performed, a water knockout unit may be utilized to remove the water from the purified thermal gas. The optional water knockout unit may be a simple tank, drum, or vessel, and may use one or multiple stages of water separation.

Additionally, or alternatively, a gas-separation unit may be utilized to remove light gases from the purified thermal gas. Light gases may include methane, ethane, propane, ethylene, propylene, and the like. Light gases can be burned with the resulting heat provided to the process. The optional gas-separation unit may use distillation (which may be cryogenic distillation or vacuum distillation), membranes, molecular sieves, or other means of separating light gases from the thermal gas. In certain embodiments, some light gases, such as methane, remain in the thermal gas while heavier (but still light) gases, such as propane or butane, are removed. In certain embodiments, some light gases, such as methane, are removed from the thermal gas (e.g., to be recovered as renewable natural gas) while heavier (but still light) gases, such as propane or butane, are allowed to remain in the thermal gas.

In some embodiments, thermal gas purification generates a $N_2$ stream that may be released to the atmosphere. In principle, the $N_2$ may be recovered and sold, such as a liquid nitrogen co-product. The $N_2$ may be utilized in the Haber process for ammonia synthesis by reacting the $N_2$ with $H_2$ (such as $H_2$ from the thermal gas) to produce $NH_3$.

The desired ultimate composition of the thermal gas will usually be dictated by its final use.

In some embodiments, the purified thermal gas is recovered and stored or shipped. Shipping of purified thermal gas may be via truck, train, underground pipeline, above-ground piping to an adjacent facility, or other means of shipping.

In some embodiments, the purified thermal gas is pressurized to a pressure selected from about 10 bar to about 1000 bar. A common pressure range is from about 7 bar to about 700 bar, with 100 bar being typical. In certain embodiments, the purified thermal gas is compressed or cooled to a liquid state. The purified thermal gas may be pressurized or liquefied for storage, or may be pressurized or liquefied for feeding to a high-pressure reactor, for example.

The purified thermal gas may be further catalytically converted into a product selected from the group consisting of methane, methanol, dimethyl ether, ethanol, diethyl ether, acetic acid, acetaldehyde, ethylene, propylene, Fischer-Tropsch liquids, Fischer-Tropsch waxes, gasoline, diesel fuel, jet fuel, and combinations thereof. The conversion of the purified thermal gas to one or more of such products may occur at the same site as the manure-to-thermal gas process, or at a different site that receives the thermal gas for further processing.

The purified thermal gas may be catalytically converted into renewable natural gas ("RNG"). The renewable natural gas preferably meets RNG specifications according to the American Biogas Council, for example. In some embodiments, the renewable natural gas contains at least 90 vol % $CH_4$, and is characterized by a higher heating value of at least 975 BTU/scf (about 36 $MJ/m^3$). The conversion of thermal gas to renewable natural gas utilizes a methanation catalyst, which may be nickel-based or ruthenium-based, for example. Exemplary methanation catalysts are $Ni/CeO_2$ and $Ni/TiO_3/Al_2O_3$.

The purified thermal gas may be catalytically converted into renewable gasoline, renewable diesel fuel, or renewable jet fuel. The conversion of thermal gas to these hydrocarbon-rich liquid fuels may utilize Fischer-Tropsch chemistry, which has been used industrially for nearly a century. The conversion of CO to alkanes involves hydrogenation of CO from the thermal gas, the hydrogenolysis (cleavage with $H_2$ from the thermal gas) of C—O bonds, and the formation of C—C bonds. The conversion of thermal gas to renewable gasoline, renewable diesel fuel, or renewable jet fuel does not require Fischer-Tropsch reactions, however. For example, the thermal gas may be converted to methanol, followed by conversion of the methanol to light olefins, followed by oligomerization and hydrogenation to make higher hydrocarbons.

In some embodiments, the thermal gas is converted to aviation fuel that qualifies as sustainable aviation fuel under ASTM D7566-24a. This patent application hereby incorporates by reference ASTM D7566-24A "Standard Specification for Aviation Turbine Fuel Containing Synthesized Hydrocarbons". In certain embodiments, the aviation fuel does not necessarily qualify as a sustainable aviation fuel under ASTM D7566-24a, but still meets all specifications for aviation fuel pursuant to ASTM D1655-22a, "Standard Specification for Aviation Turbine Fuels", which is incorporated by reference.

The purified thermal gas may be combusted to produce thermal energy, i.e. the capturing the heat of combustion such as via steam generation from water. Alternatively, or additionally, the purified thermal gas may be combusted to produce electrical energy in a conventional power generator.

The purified thermal gas may be further processed to produce a hydrogen product. Here, further processing may include additional water-gas shift reactions and/or separations to remove non-hydrogen species from the thermal gas or to separate out the hydrogen component. Separating $H_2$ may utilize molecular sieves (e.g., zeolites), membranes (e.g., polyimide membranes), cryogenic distillation, or a combination thereof, for example.

The solid bulk biochar as well as the solid fine biochar may have various compositions, which may be measured using ultimate analysis. Carbon, hydrogen, and nitrogen can be measured using ASTM D5373, for example. Oxygen can be measured using ASTM D3176, for example. Sulfur can be measured using ASTM D3177, for example. Ash content can be measured by ASTM D3175, for example.

The solid bulk biochar may have from about 40 wt % carbon to about 70 wt % carbon, such as from about 50 wt % carbon to about 60 wt % carbon, on a dry basis. The solid bulk biochar may have from about 30 wt % ash to about 50 wt % ash, such as from about 35 wt % ash to about 45 wt % ash, on a dry basis. The solid bulk biochar may have from about 0.1 wt % hydrogen to about 1 wt % hydrogen, on a dry basis. The solid bulk biochar may have from about 0.5 wt % oxygen to about 3 wt % oxygen, on a dry basis. The solid bulk biochar may have from about 0.5 wt % nitrogen to about 3 wt % nitrogen, on a dry basis. The solid bulk biochar may have from about 0.1 wt % sulfur to about 1 wt % sulfur, on a dry basis.

The solid fine biochar may have the same composition as the solid bulk biochar, but that is not necessarily the case. The solid fine biochar may have from about 40 wt % carbon to about 70 wt % carbon, such as from about 50 wt % carbon to about 60 wt % carbon, on a dry basis. The solid fine biochar may have from about 30 wt % ash to about 50 wt % ash, such as from about 35 wt % ash to about 45 wt % ash, on a dry basis. The solid fine biochar may have from about 0.1 wt % hydrogen to about 1 wt % hydrogen, on a dry basis. The solid fine biochar may have from about 0.5 wt % oxygen to about 3 wt % oxygen, on a dry basis. The solid fine biochar may have from about 0.5 wt % nitrogen to about 3 wt % nitrogen, on a dry basis. The solid fine biochar may have from about 0.1 wt % sulfur to about 1 wt % sulfur, on a dry basis.

When the bulk biochar and fine biochar are combined to create a single solid biochar, that combined biochar may have from about 40 wt % carbon to about 70 wt % carbon, such as from about 50 wt % carbon to about 60 wt % carbon, on a dry basis. The combined biochar may have from about 30 wt % ash to about 50 wt % ash, such as from about 35 wt % ash to about 45 wt % ash, on a dry basis. The solid fine biochar may have from about 0.1 wt % hydrogen to about 1 wt % hydrogen, on a dry basis. The combined biochar may have from about 0.5 wt % oxygen to about 3 wt % oxygen, on a dry basis. The combined biochar may have from about 0.5 wt % nitrogen to about 3 wt % nitrogen, on a dry basis. The combined biochar may have from about 0.1 wt % sulfur to about 1 wt % sulfur, on a dry basis.

Reference here to "solid biochar" may be in reference to only the solid bulk biochar, only the solid fine biochar, or a mixture of the solid bulk biochar and the solid fine biochar. Unless otherwise stated, any use of biochar may utilize solid bulk biochar, solid fine biochar, or a mixture thereof.

In the solid biochar, some or all of the carbon may be present as graphite. The presence or concentration of graphite may be measured by spectroscopy. In this specification, "spectroscopy" refers to the measurement of spectra produced when matter (in this case, a sample of solid biochar) interacts with or emits electromagnetic radiation. As is known in the graphite art, there are several spectroscopic methods that can be used to determine crystallinity of carbon. In some embodiments, crystalline graphite is determined according to X-ray diffraction (XRD). In some embodiments, crystalline graphite is determined according to Raman spectroscopy, utilizing inelastic (Raman) scattering of photons. In some embodiments, crystalline graphite is determined according to combined XRD-Raman spectroscopy.

In some embodiments, the solid biochar is recovered in the form of a graphite-containing product with at least 50 wt % crystalline graphite. In certain embodiments, the graphite-containing product contains at least 90 wt % crystalline graphite. In various embodiments, the solid biochar contains about, or at least about 50%, 55%, 60%, 65%, 70%, 75%, 80%, 85%, 90%, or 95% crystalline graphite, including any intervening range. The graphite crystallinity may be determined according to from x-ray photoelectron spectroscopy, Raman spectroscopy, near-edge x-ray absorption spectroscopy, or electron energy-loss spectroscopy, for example.

In some embodiments, the solid biochar is recovered as a biochar co-product. A biochar co-product may be utilized in cement, concrete, or asphalt, which effectively sequesters the carbon content of the biochar. For these applications, the biochar may be the solid bulk biochar, the solid fine biochar, or a mixture of both solid bulk biochar and solid fine biochar.

The relatively high ash content (e.g., 30-50 wt % ash) of the solid biochar may be problematic for some applications such as biochar combustion, but it may be beneficial for other applications, such as concrete, asphalt, and certain polymer composites. The usefulness in certain applications may depend on the specific ash profile—i.e., the specific concentrations of $SiO_2$, $Al_2O_3$, MgO, CaO, $K_2O$, $P_2O_5$, etc. In the case of dairy manure as the starting feedstock, the biochar ash composition tends to be dominated by silica ($SiO_2$) since the starting manure usually has a high silica concentration.

In some embodiments, the solid biochar is used to make a biochar-polymer composite. To produce a biochar-polymer composite, a quantity of solid biochar may be physically combined with a quantity of a selected polymer. The combination may utilize some type of mixer, such as an extruder, roll mill, ball mill, planetary mixer, or blender. Optionally, heat is applied to the mixing to assist in composite formation, or internal heat generated by the mixing assists in composite formation (e.g., enhancing convection, diffusion, or non-covalent bonding). Typically, no covalent chemical bonding occurs between the biochar and the polymer, although such bonding is not precluded. Various types of bonding may be present between the biochar and the polymer, such as (but not limited to) Van der Waals forces, electrostatic interaction, x-x stacking, hydrogen bonding, and covalent bonding.

In a biochar-polymer composite, the polymer may vary widely and may be selected from thermoplastic polymers or thermoset polymers. The polymer may be selected from the group consisting of polyolefins, polyols, polyesters, polyamides, polyimides, polylactides, polystyrenes, polyepoxides, polycarbonates, polyacrylates, polyisoprenes, polycyanurates, polyfurans, styrenic rubbers, natural rubbers, synthetic rubbers, polyurethanes, polyureas, polyamide-enamines, polyanhydrides, polyhydroxyalkanoates, polyalkene dicarboxylates, silicones, thermoplastics elastomers, thermoplastic polyurethanes, phenol-formaldehyde resins, aliphatic-aromatic copolyesters, and combinations or copolymers thereof.

Natural rubber is mainly poly-cis-isoprene. Synthetic rubber is made from various petroleum-based monomers. The most prevalent synthetic rubbers are styrene-butadiene rubbers (SBR) derived from the copolymerization of styrene and 1,3-butadiene. Other synthetic rubbers are prepared from isoprene (2-methyl-1,3-butadiene, yielding polyisoprene), chloroprene (2-chloro-1,3-butadiene), and isobutylene (methylpropene) with a small percentage of isoprene for crosslinking (making butyl rubber).

In various embodiments, a polymer is selected from the group consisting of polyethylene, polypropylene, polybutene, polyisobutylene, polybutadiene, polyisoprene, poly (ethylene-co-acrylic acid), polylactic acid (or polylactide), poly(glycolic acid) (or polyglycolide), poly(hydroxybutyrate), poly(butylene adipate-co-terephthalate), poly(butylene succinate), poly(hydroxybutyrate-co-hydroxyvalerate), poly(ethylene terephthalate), polyvinyl alcohol, polystyrene, poly(butyl acrylate), poly(tert-butyl acrylate-co-ethyl acrylate-co-methacrylic acid), poly(ethyl acrylate), poly(2-ethylhexyl acrylate), poly(methyl acrylate), polyacrylonitrile, poly(acrylonitrile-co-methyl acrylate), poly(styrene-co-maleic anhydride), poly(methyl methacrylate), poly(alkyl methacrylate), polyvinylcyclohexane, poly(Bisphenol A carbonate), poly(propylene carbonate), poly(1,4-butylene adipate), poly(1,4-butylene succinate), poly(1,4-butylene terephthalate), poly(ethylene succinate), poly(vinyl acetate), poly(propylene glycol), poly(tetrahydrofuran), poly(ethyl vinyl ether), polydimethylsiloxane, nylons (aliphatic polyamides), and combinations or copolymers thereof.

Polymers that may be included in a composite product may be hydrophobic, partially hydrophobic, or hydrophilic. Hydrophilic polymers may be modified to render them at least partially hydrophobic, with suitable coatings or combinations of components (e.g., interpenetrating networks of polymers).

In some embodiments, a selected polymer is bio-based, biodegradable, and/or compostable. In some embodiments, the polymer is or includes a biodegradable polymer, such as any polymer described in Vroman and Tighzert, "Biodegradable Polymers," *Materials* 2009, 2, 307-344, which is hereby incorporated by reference herein.

In some embodiments, a biochar-polymer composite has at least 50%, 60%, 70%, 80%, 90%, 95%, or 100% renewable carbon content, according to a measurement of the $^{14}C/^{12}C$ isotopic ratio of the biochar-polymer composite.

Many types of composite products are possible, including films, coatings, packaging, utensils, fibers, fabrics, apparel, durable goods, nonwovens, and so on. The composite product may be in the form of an extruded part, injection-molded part, blow-molded part, spun fiber, pellet, layered sheet, film, foam, container, bag, engineered part, 3D-printing substrate, 3D-printed part, or a combination thereof, for example.

In some embodiments, the biochar-polymer composite is black in color. Such a composite may be referred to as a black biochar-polymer composite. In such a composite, the biochar may replace carbon black or other black pigment, dye, or ink that would otherwise be used to color the polymer black. The amount of solid biochar used in the composite may be the amount needed to achieve a desired black color, or may be a higher amount (such as to influence other properties), or a lower amount (such as when a dark but not necessarily black composite is desired).

The black color of the solid biochar, and the resulting biochar-polymer composite, may be quantified using blackness, jetness, and undertone, which are well-known in the carbon black arts and can be adapted for biochar. Blackness is the degree of darkness based on how much light is reflected from the biochar. Jetness is a color-dependent measure of blackness that considers the hue of the biochar. Undertone is the contribution of the biochar's hue to its blackness.

In some embodiments, the biochar solely functions as a black pigment, which is regarded as both aesthetic as well as functional (e.g., black helps absorb solar energy). In other embodiments, the biochar functions not only as a black pigment but also provides one or more non-color properties, such as (but not limited to) UV resistance, durability enhancement, improved mechanical strength, smear hiding, or modification of electrical conductivity for the composite. In still other embodiments, the biochar is added only as a renewable filler and not necessarily as functional additive provided to darken the color or to modify other properties.

There are many uses of black biochar-polymer composites. To name only a few, the black biochar-polymer composite may be used in consumer goods, electronics, vehicle interiors, vehicle tires, pipes, hoses, construction tools, household tools, food packaging, kitchenware, antistatic components, electromagnetic shields, sensors, weather stripping, seals, molded parts, vibration-damping components, UV-stabilizing components, and consumer toys. The black biochar-polymer composite may be a single-use product, a semi-permanent product, or a permanent product. The black biochar-polymer composite may be designed for indoor use, outdoor use, or generic use.

Carbon black produced from incomplete combustion of natural gas or hydrocarbon oils is the dominant additive in rubber and plastics applications. Carbon black provides reinforcement, toughness, UV resistance, static dissipative properties, and electrical conductivity. However, conventional carbon black is produced from fossil fuels and is made in an energy-intensive, dirty process that emits $NO_x$ and $SO_x$ to the air. While carbon itself is not considered to be carcinogenic, commercial carbon black commonly contains organic contaminants such as polycyclic aromatic hydrocarbons, which have been identified as human carcinogens. Finally, carbon black has significant pricing volatility because its price is indexed to the price of crude oil.

By contrast, the biochar provided in this disclosure is a renewable, sustainable material that can replace carbon black in various applications. In some embodiments, the biochar has similar or improved impact resistance, compared to conventional carbon black. In some embodiments, the biochar has similar or improved flow in polymer melting processing, compared to conventional carbon black. In some embodiments, the biochar has improved UV resistance, compared to conventional carbon black. In some embodiments, the biochar has similar or improved stress and strain at break and yield, compared to conventional carbon black. In some embodiments, the biochar has lower density, compared to conventional carbon black, which allows for weight reduction of the composite.

As stated above, the relatively high ash content of the solid biochar may be beneficial for certain applications. One example is vehicle tires. It is known that tires conventionally incorporate large amounts of carbon black. More recently, silica has been added to tires to improve rolling resistance, wet grip, and durability, which leads to better fuel efficiency and longer tread life. Silica can also enhance a tire's resistance to cuts and tears. Some tires have both silica and carbon black as complementary fillers that offer different benefits related to grip, rolling resistance, and durability. The disclosed biochar can potentially replace both carbon black and silica in a tire, since most of the ash is silica when the animal manure is dairy manure or other manure containing high concentrations of silica.

In some embodiments, the biochar-polymer composite contains from about 1 wt % to about 50 wt % biochar, from about 50 wt % to about 99 wt % of a polymer (or combination of polymers), and from 0 to about 49 wt % of one or more additives that are not the biochar or the polymer(s). In certain embodiments, the biochar-polymer composite contains from about 2 wt % to about 20 wt % biochar, from about 50 wt % to about 98 wt % of a polymer (or combination of polymers), and from 0 to about 48 wt % of one or more additives that are not the biochar or the polymer(s). In various embodiments, the biochar-polymer composite contains about, at least about, or at most about 0.1, 0.5, 1, 2, 3, 4, 5, 6, 7, 8, 9, 10, 11, 12, 13, 14, 15, 16, 17, 18, 19, 20, 25, 30, 35, 40, 45, 50, 55, 60, 65, 70, 75, 80, 85, 90, 95, 99, or 99.9 wt % biochar, including any intervening range.

The biochar-polymer composite may contain various additives. Exemplary additives include natural polymers, such as starch, cellulose, or lignin; minerals, such as alumina, talc, or calcium carbonate; ceramic materials, such as silicon carbide or titanium dioxide; etc.

In some embodiments, the biochar is present in cement. In some embodiments, the cement contains from about 1 wt % to about 50 wt % biochar. In certain embodiments, the cement contains from about 2 wt % to about 20 wt % biochar. In various embodiments, the cement contains about, at least about, or at most about 0.1, 0.5, 1, 2, 3, 4, 5, 6, 7, 8, 9, 10, 11, 12, 13, 14, 15, 16, 17, 18, 19, 20, 25, 30, 35, 40, 45, or 50 wt % biochar, including any intervening range.

In some embodiments, the biochar is present in concrete. In some embodiments, the concrete contains from about 1 wt % to about 20 wt % biochar. In certain embodiments, the concrete contains from about 2 wt % to about 10 wt % biochar. In various embodiments, the concrete contains about, at least about, or at most about 0.1, 0.5, 1, 2, 3, 4, 5, 6, 7, 8, 9, 10, 11, 12, 13, 14, 15, 16, 17, 18, 19, or 20 wt % biochar, including any intervening range.

In some embodiments, the biochar is present in asphalt. In some embodiments, the asphalt contains from about 1 wt % to about 50 wt % biochar. In certain embodiments, the asphalt contains from about 2 wt % to about 20 wt % biochar. In various embodiments, the asphalt contains about, at least about, or at most about 0.1, 0.5, 1, 2, 3, 4, 5, 6, 7, 8, 9, 10, 11, 12, 13, 14, 15, 16, 17, 18, 19, 20, 25, 30, 35, 40, 45, or 50 wt % biochar, including any intervening range.

In some embodiments, the carbon dioxide from step (j) is recovered as a $CO_2$ co-product. The $CO_2$ co-product may be sold to the food and beverage industry, compressed and sold as dry ice, or sequestered in a geological formation, for example.

The disclosed process is preferably continuous or semi-continuous. It is technically possible to perform the process batchwise, but a continuous or semi-continuous process is more economic.

As will be appreciated by a skilled artisan, the order of certain steps may vary. As just one example, acid-gas removal (or possibly $CO_2$ removal but not sulfur removal) may be performed prior to water-gas shift. Light-gas separation may be performed prior to acid-gas removal and also possibly prior to water-gas shift.

As will also be appreciated by a skilled artisan (such as a chemical engineer), there are many integration and recycle options within the process. One example is that it is desirable to recycle a portion of dried solids from the thermal reactor, or from the pelletizer, back to the manure dryer to enhance mixing and drying effectiveness. Reactor product streams (e.g., exiting the thermal reactor, the tar-reforming reactor, or the WGS reactor) may be partially recycled to allow higher conversion to desired products. One skilled in the art may simulate the entire process using process simulation software, such as Aspen Plus, to close the mass and energy balances at steady state even with potentially complex recycle and integration schemes.

Other variations provide a process for converting animal manure into electricity, the process comprising:

(a) providing starting animal manure, wherein the starting animal manure has an average moisture content from about 30 wt % to about 90 wt % $H_2O$;

(b) drying the animal manure in a manure dryer operated at a drying temperature selected from about 50° C. to about 350° C. to generate a dried animal manure, wherein the dried animal manure has an average moisture content from about 15 wt % to about 40 wt % $H_2O$;

(c) pelletizing the dried animal manure in a manure pelletizer to generate manure pellets, wherein the manure pellets have an average moisture content from 0 wt % to about 20 wt % $H_2O$;

(d) thermally reacting the manure pellets in a thermal reactor operated at a reaction temperature selected from about 600° C. to about 1200° C., to generate an intermediate thermal gas and a solid biochar from the manure pellets, wherein the intermediate thermal gas contains at least $H_2$, CO, $CO_2$, $CH_4$, and $H_2O$, and wherein the solid biochar contains at least carbon and ash;

(e) separating the solid biochar from the intermediate thermal gas;

(f) optionally, feeding the intermediate thermal gas to a tar-reforming reactor operated at a tar-reforming temperature selected from about 1200° C. to about 1600° C.; and (g) feeding the intermediate thermal gas, or a compressed form thereof, to one or more power generators configured to produce electricity.

Other variations provide a process for converting animal manure into thermal energy, the process comprising:

(a) providing starting animal manure, wherein the starting animal manure has an average moisture content from about 30 wt % to about 90 wt % $H_2O$;

(b) drying the animal manure in a manure dryer operated at a drying temperature selected from about 50° C. to about 350° C. to generate a dried animal manure, wherein the dried animal manure has an average moisture content from about 15 wt % to about 40 wt % $H_2O$;

(c) pelletizing the dried animal manure in a manure pelletizer to generate manure pellets, wherein the manure pellets have an average moisture content from 0 wt % to about 20 wt % $H_2O$;

(d) thermally reacting the manure pellets in a thermal reactor operated at a reaction temperature selected from about 600° C. to about 1200° C., to generate an intermediate thermal gas and a solid biochar from the manure pellets, wherein the intermediate thermal gas contains at least $H_2$, CO, $CO_2$, $CH_4$, and $H_2O$, and wherein the solid biochar contains at least carbon and ash;

(e) separating the solid biochar from the intermediate thermal gas;

(f) optionally, feeding the intermediate thermal gas to a tar-reforming reactor operated at a tar-reforming temperature selected from about 1200° C. to about 1600° C.;

(g) feeding the intermediate thermal gas to a condensing unit, to generate a cooled thermal gas and a separated liquid stream;

(h) optionally, compressing the cooled thermal gas using a compression unit, to generate a compressed thermal gas, wherein the compressed thermal gas is at a pressure from about 5 bar to about 55 bar;

(i) treating the cooled thermal gas, or the compressed thermal gas if step (h) is performed, using an acid-gas removal unit operated to remove at least a portion of carbon dioxide as well as at least a portion of sulfur-containing compounds from the shifted thermal gas or the compressed thermal gas, respectively, to generate a purified thermal gas;

(j) optionally, removing water from the purified thermal gas; and (k) feeding the purified thermal gas to one or more combustion units configured to produce thermal energy.

Other variations provide a process for converting animal manure into electricity, the process comprising:

(a) providing starting animal manure, wherein the starting animal manure has an average moisture content from about 30 wt % to about 90 wt % $H_2O$;

(b) drying the animal manure in a manure dryer operated at a drying temperature selected from about 50° C. to about 350° C. to generate a dried animal manure, wherein the dried animal manure has an average moisture content from about 15 wt % to about 40 wt % $H_2O$;

(c) pelletizing the dried animal manure in a manure pelletizer to generate manure pellets, wherein the manure pellets have an average moisture content from 0 wt % to about 20 wt % $H_2O$;

(d) thermally reacting the manure pellets in a thermal reactor operated at a reaction temperature selected from about 600° C. to about 1200° C., to generate an intermediate thermal gas and a solid biochar from the manure pellets, wherein the intermediate thermal gas contains at least $H_2$, CO, $CO_2$, $CH_4$, and $H_2O$, and wherein the solid biochar contains at least carbon and ash;

(e) separating the solid biochar from the intermediate thermal gas;

(f) optionally, feeding the intermediate thermal gas to a tar-reforming reactor operated at a tar-reforming temperature selected from about 1200° C. to about 1600° C.;

(g) feeding the intermediate thermal gas to a condensing unit, to generate a cooled thermal gas and a separated liquid stream;

(h) optionally, compressing the cooled thermal gas using a compression unit, to generate a compressed thermal gas, wherein the compressed thermal gas is at a pressure from about 5 bar to about 55 bar;

(i) treating the cooled thermal gas, or the compressed thermal gas if step (h) is performed, using an acid-gas removal unit operated to remove at least a portion of carbon dioxide as well as at least a portion of sulfur-containing compounds from the shifted thermal gas or the compressed thermal gas, respectively, to generate a purified thermal gas;

(j) optionally, removing water from the purified thermal gas; and (k) feeding the purified thermal gas, or a compressed form thereof, to one or more power generators configured to produce electricity.

Other variations provide a process for converting animal manure into a purified thermal gas, a biochar co-product, and a $CO_2$ co-product, the process comprising:

(a) providing starting animal manure, wherein the starting animal manure has an average moisture content from about 30 wt % to about 90 wt % $H_2O$;

(b) drying the animal manure in a manure dryer operated at a drying temperature selected from about 50° C. to about 350° C. to generate a dried animal manure, wherein the dried animal manure has an average moisture content from about 15 wt % to about 40 wt % $H_2O$;

(c) pelletizing the dried animal manure in a manure pelletizer to generate manure pellets, wherein the manure pellets have an average moisture content from 0 wt % to about 20 wt % $H_2O$;

(d) thermally reacting the manure pellets in a thermal reactor operated at a reaction temperature selected from about 600° C. to about 1200° C., to generate an intermediate thermal gas and a solid biochar from the manure pellets, wherein the intermediate thermal gas contains at least $H_2$, CO, $CO_2$, $CH_4$, and $H_2O$, and wherein the solid biochar contains at least carbon and ash;

(e) separating the solid biochar from the intermediate thermal gas;

(f) optionally, feeding the intermediate thermal gas to a tar-reforming reactor operated at a tar-reforming temperature selected from about 1200° C. to about 1600° C.;

(g) feeding the intermediate thermal gas to a condensing unit, to generate a cooled thermal gas and a separated liquid stream;

(h) compressing the cooled thermal gas using a compression unit, to generate a compressed thermal gas, wherein the compressed thermal gas is at a pressure from about 5 bar to about 55 bar;

(i) catalytically reacting the compressed thermal gas in a water-gas shift reactor operated at a water-gas shift temperature selected from about 200° C. to about 550° C., to generate a shifted thermal gas having an adjusted $H_2$/CO ratio compared to a $H_2$/CO ratio of the compressed thermal gas;

(j) treating the shifted thermal gas using an acid-gas removal unit operated to remove at least a portion of carbon dioxide as well as at least a portion of sulfur-containing compounds from the shifted thermal gas, to generate a purified thermal gas;

(k) optionally, removing water and/or light gases from the purified thermal gas;

(l) recovering or further processing the purified thermal gas;

(m) recovering the solid biochar from step (e) as a biochar co-product; and (n) recovering the carbon dioxide from step (j) as a $CO_2$ co-product.

Other variations provide a process for converting animal manure into a hydrogen product, the process comprising:

(a) providing starting animal manure, wherein the starting animal manure has an average moisture content from about 30 wt % to about 90 wt % $H_2O$;

(b) drying the animal manure in a manure dryer operated at a drying temperature selected from about 50° C. to about 350° C. to generate a dried animal manure, wherein the dried animal manure has an average moisture content from about 15 wt % to about 40 wt % $H_2O$;

(c) pelletizing the dried animal manure in a manure pelletizer to generate manure pellets, wherein the manure pellets have an average moisture content from 0 wt % to about 20 wt % $H_2O$;

(d) thermally reacting the manure pellets in a thermal reactor operated at a reaction temperature selected from about 600° C. to about 1200° C., to generate an intermediate thermal gas and a solid biochar from the manure pellets, wherein the intermediate thermal gas contains at least $H_2$, CO, $CO_2$, $CH_4$, and $H_2O$, and wherein the solid biochar contains at least carbon and ash;

(e) separating the solid biochar from the intermediate thermal gas;

(f) optionally, feeding the intermediate thermal gas to a tar-reforming reactor operated at a tar-reforming temperature selected from about 1200° C. to about 1600° C.;

(g) feeding the intermediate thermal gas to a condensing unit, to generate a cooled thermal gas and a separated liquid stream;

(h) compressing the cooled thermal gas using a compression unit, to generate a compressed thermal gas, wherein the compressed thermal gas is at a pressure from about 5 bar to about 55 bar;

(i) catalytically reacting the compressed thermal gas in a water-gas shift reactor operated at a water-gas shift temperature selected from about 200° C. to about 550° C., to generate a shifted thermal gas having a higher $H_2$/CO ratio compared to a $H_2$/CO ratio of the compressed thermal gas;

(j) treating the shifted thermal gas using an acid-gas removal unit operated to remove at least a portion of carbon dioxide as well as at least a portion of sulfur-containing compounds from the shifted thermal gas, to generate a purified thermal gas;

(k) optionally, removing water and/or light gases from the purified thermal gas; and (l) recovering the purified thermal gas, or a further-processed form thereof, as a hydrogen product.

A specific process embodiment will now be described, without limitation. First, dairy manure at greater than 50 wt % moisture is dried to near 20 wt % moisture. The manure then is pelletized (~¼" diameter by ~1" long) with a resulting pellet moisture of about 12 wt %. The pellets are exposed to high heating rates at about 1000° C. in the absence or near absence of oxygen or air. The solid exposure rate is from 10 minutes to 40 minutes in a rotating kiln reactor or auger screw reactor. The gas residence time is between 1 second and 60 seconds at steady state. The solid biochar is removed by gravity separation and cyclonic separation and immediately cooled by water (spray) addition to near room temperature (about 25° C.). The biochar is then reduced in particle size by milling or similar operation for use in biochar-polymer composites. The separated hot produced gas is optionally exposed to a partial-oxidation reactor to remove possible tars. Then the hot gas is cooled with water is knocked out. The produced thermal gas is then optionally modified depending on the final desired gas product.

Some variations of the invention provide a system configured for converting animal manure into a purified thermal gas, the system comprising:

a manure dryer with a dryer inlet and a dryer outlet, wherein the manure dryer is configured to receive a starting animal manure and to operate at a drying temperature to generate a dried animal manure;

a manure pelletizer with a pelletizer inlet and a pelletizer outlet, wherein the pelletizer inlet is in flow communication with the dryer outlet, and wherein the manure pelletizer is configured to generate manure pellets;

a thermal reactor with a thermal-reactor inlet and a thermal-reactor outlet, wherein the thermal-reactor inlet is in flow communication with the pelletizer outlet, and wherein the thermal reactor is configured to operate at a reaction temperature to generate an intermediate thermal gas and a solid biochar;

optionally, a biochar separation unit in flow communication with the thermal-reactor outlet, wherein the biochar separation unit is configured to remove fine particles of the solid biochar from the intermediate thermal gas;

optionally, a tar-reforming reactor with a tar-reforming reactor inlet and a tar-reforming reactor outlet, wherein the tar-reforming reactor inlet is in flow communication with the thermal-reactor outlet or with the biochar separation unit, if present, and wherein the tar-reforming reactor is configured to operate at a tar-reforming temperature;

a condensing unit with a condenser inlet, a condenser vapor outlet, and a condenser liquid outlet, wherein the condenser inlet is in flow communication with the thermal-reactor outlet or with the biochar separation unit, if present, or with the tar-reforming reactor outlet, if the tar-reforming reactor is present, and wherein the condensing unit is configured to generate a cooled thermal gas and a separated liquid stream;

a compression unit with a compression-unit inlet and a compression-unit outlet, wherein the compression-unit inlet is in flow communication with the condenser vapor outlet, and wherein the compression unit is configured to generate a compressed thermal gas;

a water-gas shift reactor with a WGS reactor inlet and a WGS reactor outlet, wherein the WGS reactor inlet is in flow communication with the compression-unit outlet, and wherein the water-gas shift reactor is configured to catalytically generate a shifted thermal gas having an adjusted $H_2/CO$ ratio compared to a $H_2/CO$ ratio of the compressed thermal gas;

an acid-gas removal unit having an AGRU inlet, an AGRU $CO_2$ outlet, and an AGRU sulfur outlet, wherein the AGRU inlet is in flow communication with the WGS reactor outlet, and wherein the acid-gas removal unit is configured to direct at least a portion of carbon dioxide from the shifted thermal gas to the AGRU $CO_2$ outlet, and to direct at least a portion of sulfur-containing compounds from the shifted thermal gas to the AGRU sulfur outlet, to generate a purified thermal gas;

optionally, a water knockout unit configured to remove water from the purified thermal gas; and optionally, a light-gas separation unit configured to remove light gases from the purified thermal gas.

Other variations provide a system configured for converting animal manure into electricity, the system comprising:

a manure dryer with a dryer inlet and a dryer outlet, wherein the manure dryer is configured to receive a starting animal manure and to operate at a drying temperature to generate a dried animal manure;

a manure pelletizer with a pelletizer inlet and a pelletizer outlet, wherein the pelletizer inlet is in flow communication with the dryer outlet, and wherein the manure pelletizer is configured to generate manure pellets;

a thermal reactor with a thermal-reactor inlet and a thermal-reactor outlet, wherein the thermal-reactor inlet is in flow communication with the pelletizer outlet, and wherein the thermal reactor is configured to operate at a reaction temperature to generate an intermediate thermal gas and a solid biochar;

optionally, a biochar separation unit in flow communication with the thermal-reactor outlet, wherein the biochar separation unit is configured to remove fine particles of the solid biochar from the intermediate thermal gas;

optionally, a tar-reforming reactor with a tar-reforming reactor inlet and a tar-reforming reactor outlet, wherein the tar-reforming reactor inlet is in flow communication with the thermal-reactor outlet or with the biochar separation unit, if present, and wherein the tar-reforming reactor is configured to operate at a tar-reforming temperature; and one or more power generators configured to produce electricity from the intermediate thermal gas.

Other variations provide a system configured for converting animal manure into thermal energy, the system comprising:

a manure dryer with a dryer inlet and a dryer outlet, wherein the manure dryer is configured to receive a starting animal manure and to operate at a drying temperature to generate a dried animal manure;

a manure pelletizer with a pelletizer inlet and a pelletizer outlet, wherein the pelletizer inlet is in flow communication with the dryer outlet, and wherein the manure pelletizer is configured to generate manure pellets;

a thermal reactor with a thermal-reactor inlet and a thermal-reactor outlet, wherein the thermal-reactor inlet is in flow communication with the pelletizer outlet, and wherein the thermal reactor is configured to operate at a reaction temperature to generate an intermediate thermal gas and a solid biochar;

optionally, a biochar separation unit in flow communication with the thermal-reactor outlet, wherein the biochar separation unit is configured to remove fine particles of the solid biochar from the intermediate thermal gas;

optionally, a tar-reforming reactor with a tar-reforming reactor inlet and a tar-reforming reactor outlet, wherein the tar-reforming reactor inlet is in flow communication with the thermal-reactor outlet or with the biochar separation unit, if present, and wherein the tar-reforming reactor is configured to operate at a tar-reforming temperature;

a condensing unit with a condenser inlet, a condenser vapor outlet, and a condenser liquid outlet, wherein the condenser inlet is in flow communication with the thermal-reactor outlet or with the biochar separation unit, if present, or with the tar-reforming reactor outlet, if the tar-reforming reactor is present, and wherein the condensing unit is configured to generate a cooled thermal gas and a separated liquid stream;

optionally, a compression unit with a compression-unit inlet and a compression-unit outlet, wherein the compression-unit inlet is in flow communication with the condenser vapor outlet, and wherein the compression unit is configured to generate a compressed thermal gas;

an acid-gas removal unit having an AGRU inlet, an AGRU $CO_2$ outlet, and an AGRU sulfur outlet, wherein the AGRU inlet is in flow communication with the condenser vapor outlet, or with the compression-unit outlet if the compression unit is present, and wherein the acid-gas removal unit is configured to direct at least a portion of carbon dioxide from the cooled thermal gas or the compressed thermal gas, respectively, to the AGRU $CO_2$ outlet, and to direct at least a portion of sulfur-containing compounds from the cooled thermal gas or the compressed thermal gas, respectively, to the AGRU sulfur outlet, to generate a purified thermal gas;

optionally, a water knockout unit configured to remove water from the purified thermal gas; and one or more combustion units configured to produce thermal energy from the purified thermal gas.

Other variations provide a system configured for converting animal manure into electricity, the system comprising:

a manure dryer with a dryer inlet and a dryer outlet, wherein the manure dryer is configured to receive a starting animal manure and to operate at a drying temperature to generate a dried animal manure;

a manure pelletizer with a pelletizer inlet and a pelletizer outlet, wherein the pelletizer inlet is in flow communication with the dryer outlet, and wherein the manure pelletizer is configured to generate manure pellets;

a thermal reactor with a thermal-reactor inlet and a thermal-reactor outlet, wherein the thermal-reactor inlet is in flow communication with the pelletizer outlet, and wherein the thermal reactor is configured to operate at a reaction temperature to generate an intermediate thermal gas and a solid biochar;

optionally, a biochar separation unit in flow communication with the thermal-reactor outlet, wherein the biochar separation unit is configured to remove fine particles of the solid biochar from the intermediate thermal gas;

optionally, a tar-reforming reactor with a tar-reforming reactor inlet and a tar-reforming reactor outlet, wherein the tar-reforming reactor inlet is in flow communication with the thermal-reactor outlet or with the biochar separation unit, if present, and wherein the tar-reforming reactor is configured to operate at a tar-reforming temperature;

a condensing unit with a condenser inlet, a condenser vapor outlet, and a condenser liquid outlet, wherein the condenser inlet is in flow communication with the thermal-reactor outlet or with the biochar separation unit, if present, or with the tar-reforming reactor outlet, if the tar-reforming reactor is present, and wherein the condensing unit is configured to generate a cooled thermal gas and a separated liquid stream;

optionally, a compression unit with a compression-unit inlet and a compression-unit outlet, wherein the compression-unit inlet is in flow communication with the condenser vapor outlet, and wherein the compression unit is configured to generate a compressed thermal gas;

an acid-gas removal unit having an AGRU inlet, an AGRU $CO_2$ outlet, and an AGRU sulfur outlet, wherein the AGRU inlet is in flow communication with the condenser vapor outlet, or with the compression-unit outlet if the compression unit is present, and wherein the acid-gas removal unit is configured to direct at least a portion of carbon dioxide from the cooled thermal gas or the compressed thermal gas, respectively, to the AGRU $CO_2$ outlet, and to direct at least a portion of sulfur-containing compounds from the cooled thermal gas or the compressed thermal gas, respectively, to the AGRU sulfur outlet, to generate a purified thermal gas;

optionally, a water knockout unit configured to remove water from the purified thermal gas; and one or more power generators configured to produce electricity from the purified thermal gas.

Still other variations provide a system configured for converting animal manure into a hydrogen product, the system comprising:

a manure dryer with a dryer inlet and a dryer outlet, wherein the manure dryer is configured to receive a starting animal manure and to operate at a drying temperature to generate a dried animal manure;

a manure pelletizer with a pelletizer inlet and a pelletizer outlet, wherein the pelletizer inlet is in flow communication with the dryer outlet, and wherein the manure pelletizer is configured to generate manure pellets;

a thermal reactor with a thermal-reactor inlet and a thermal-reactor outlet, wherein the thermal-reactor inlet is in flow communication with the pelletizer outlet, and wherein the thermal reactor is configured to operate at a reaction temperature to generate an intermediate thermal gas and a solid biochar;

optionally, a biochar separation unit in flow communication with the thermal-reactor outlet, wherein the biochar separation unit is configured to remove fine particles of the solid biochar from the intermediate thermal gas;

optionally, a tar-reforming reactor with a tar-reforming reactor inlet and a tar-reforming reactor outlet, wherein the tar-reforming reactor inlet is in flow communication with the thermal-reactor outlet or with the biochar separation unit, if present, and wherein the tar-reforming reactor is configured to operate at a tar-reforming temperature;

a condensing unit with a condenser inlet, a condenser vapor outlet, and a condenser liquid outlet, wherein the condenser inlet is in flow communication with the thermal-reactor outlet or with the biochar separation unit, if present, or with the tar-reforming reactor outlet, if the tar-reforming reactor is present, and wherein the condensing unit is configured to generate a cooled thermal gas and a separated liquid stream;

a compression unit with a compression-unit inlet and a compression-unit outlet, wherein the compression-unit inlet is in flow communication with the condenser vapor outlet, and wherein the compression unit is configured to generate a compressed thermal gas;

a water-gas shift reactor with a WGS reactor inlet and a WGS reactor outlet, wherein the WGS reactor inlet is in flow communication with the compression-unit outlet, and wherein the water-gas shift reactor is configured to catalytically generate a shifted thermal gas having a higher $H_2/CO$ ratio compared to a $H_2/CO$ ratio of the compressed thermal gas;

an acid-gas removal unit having an AGRU inlet, an AGRU $CO_2$ outlet, and an AGRU sulfur outlet, wherein the AGRU inlet is in flow communication with the WGS reactor outlet, and wherein the acid-gas removal unit is configured to direct at least a portion of carbon dioxide from the shifted thermal gas to the AGRU $CO_2$ outlet, and to direct at least a portion of sulfur-containing compounds from the shifted thermal gas to the AGRU sulfur outlet, to generate a purified thermal gas;

optionally, a water knockout unit configured to remove water from the purified thermal gas;

optionally, a light-gas separation unit configured to remove light gases from the purified thermal gas; and a hydrogen-recovery system outlet configured to capture the purified thermal gas as a hydrogen product.

Figure 2:
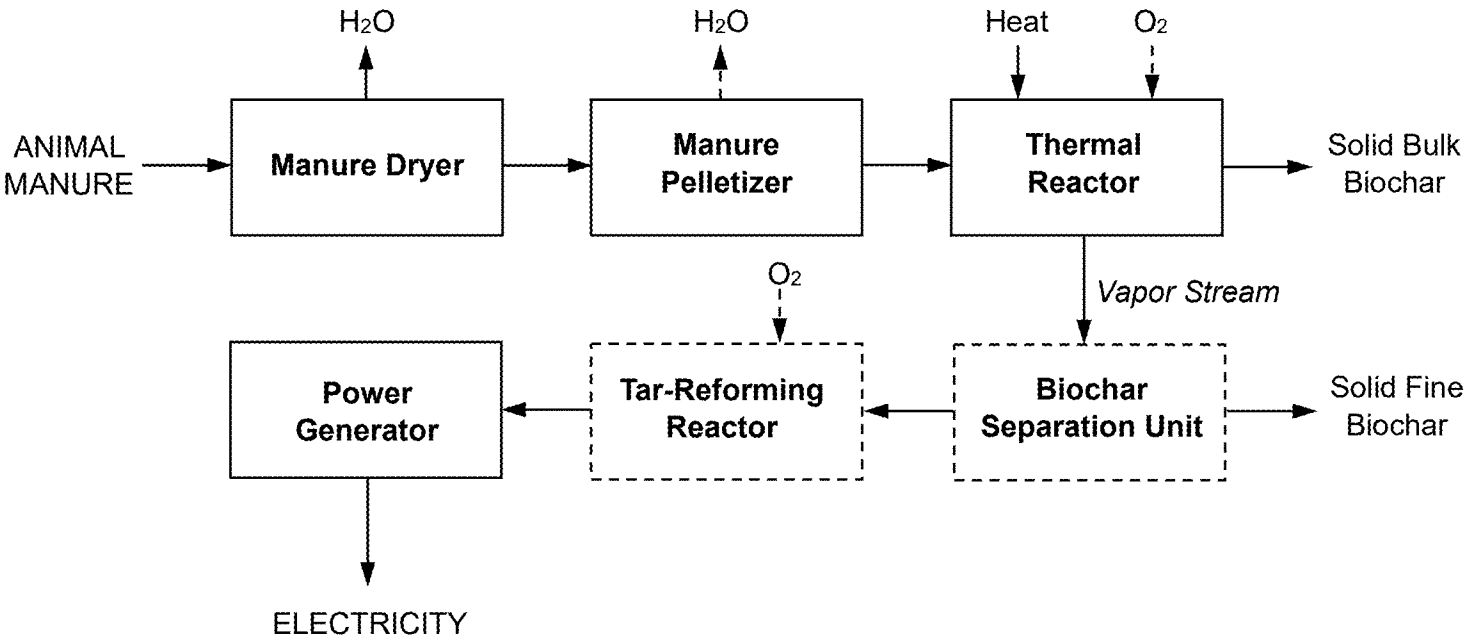
FIG. 2 is an exemplary process block-flow diagram of some embodiments for converting animal manure into electricity.
Figure 3:
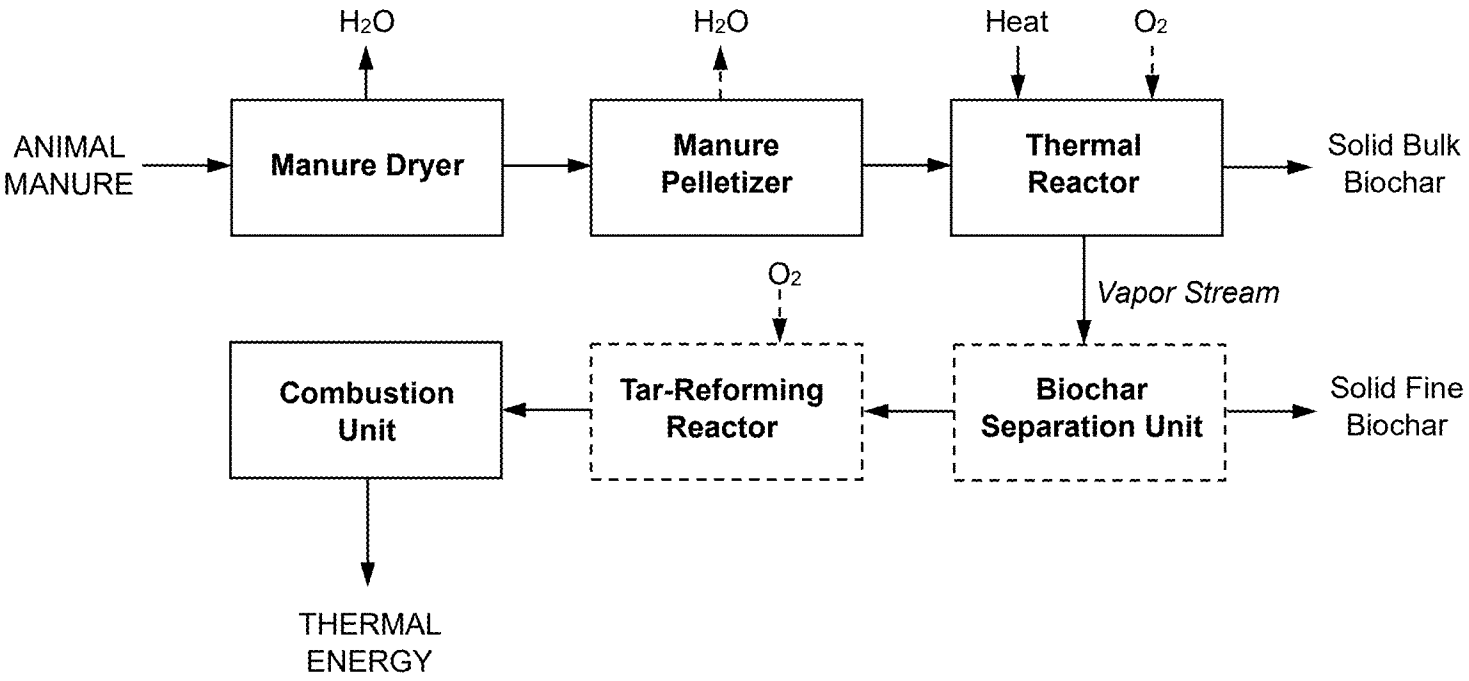
FIG. 3 is an exemplary process block-flow diagram of some embodiments for converting animal manure into thermal energy.

Various embodiments are depicted in FIGS. 1, 2, and 3. In these drawings, dotted lines and boxed denote optional streams and units, respectively. Also, FIGS. 1 to 3 depict both processes as well as systems configured to carry out the processes.

FIG. 1 is an exemplary process block-flow diagram of some embodiments for converting animal manure into purified thermal gas and solid biochar. The unit operations shown in FIG. 1 include a manure dryer, a manure pelletizer, a thermal reactor, an optional biochar separation unit, an optional tar-reforming reactor, a condensing unit, a compression unit, a water-gas shift (WGS) reactor, an acid-gas removal unit, an optional water knockout unit, and an optional light-gas separation unit. The sequence of units and steps in FIG. 1 may be varied, if desired.

FIG. 2 is an exemplary process block-flow diagram of some embodiments for converting animal manure into electricity and solid biochar. The unit operations shown in FIG. 2 include a manure dryer, a manure pelletizer, a thermal reactor, an optional biochar separation unit, an optional tar-reforming reactor, and a power generator. The sequence of units and steps in FIG. 2 may be varied, if desired.

FIG. 3 is an exemplary process block-flow diagram of some embodiments for converting animal manure into thermal energy and solid biochar. The unit operations shown in FIG. 3 include a manure dryer, a manure pelletizer, a thermal reactor, an optional biochar separation unit, an optional tar-reforming reactor, and a combustion unit. The sequence of units and steps in FIG. 3 may be varied, if desired.

The disclosed system may be stick-built or modular. Modular construction is desirable for various reasons, including often lower construction costs as well as increased flexibility to move modular units to different locations. As just one example, a module configured for making methanol from thermal gas could be located at a first site for a period of time, to make a methanol product. If that first site desired to shift to electricity product from all thermal gas (e.g., due to local demand and higher revenue for green electricity), the methanol module may be conveniently shipped to a second site, at which methanol is made from the thermal gas produced from manure at that second site.

As will be appreciated by a skilled engineer, the processes and systems of the invention may employ various process sensors and control schemes to monitor and control gas pressures, temperatures, flow rates, and compositions throughout processing. Standard or customized gas pressure, temperature, and flow gauges may be employed. Gas composition may be monitored by withdrawing a gas sample and subjecting the gas sample to mass spectrometry, gas chromatography, or FTIR spectroscopy, for example. Gas composition may be measured, for example, according to ASTM D7833, D1945, D1946, or D3588, which test methods are incorporated by reference herein. Process adjustments may be made dynamically using measurements of gas pressures, temperatures, flow rates, and/or compositions, if deemed necessary or desirable, using well-known principles of process control (feedback, feedforward, proportional-integral-derivative logic, etc.). Process adjustments and optimization may utilize artificial intelligence.

As will also be appreciated by a skilled artisan, the processes and systems of the invention may utilize various process simulations, modeling, and engineering calculations, both in the initial design as well as during operation. Process calculations and simulations may be performed using process simulation software, such as Aspen Plus® (Aspen Technology Inc., Bedford, Massachusetts, USA), as one example.

The present invention may be applied to a wide range of throughputs and product generation capacities in a given process and system. The plant capacity can be quantified in terms of dry tons of manure processed per day. The plant capacity may be about, or at least about, 1, 10, 50, 100, 200, 500, 1000, 1500, 2000, or more dry tons manure per day.

In this detailed description, reference has been made to multiple embodiments of the invention and non-limiting examples relating to how the invention can be understood and practiced. Other embodiments that do not provide all of the features and advantages set forth herein may be utilized, without departing from the spirit and scope of the present invention. This invention incorporates routine experimentation and optimization of the methods and systems described herein. Such modifications and variations are considered to be within the scope of the invention defined by the claims.

All publications, patents, and patent applications cited in this specification are herein incorporated by reference in their entirety as if each publication, patent, or patent application were specifically and individually put forth herein.

Where methods and steps described above indicate certain events occurring in certain order, those of ordinary skill in the art will recognize that the ordering of certain steps may be modified and that such modifications are in accordance with the variations of the invention. Additionally, certain of the steps may be performed concurrently in a parallel process when possible, as well as performed sequentially. Therefore, to the extent there are variations of the invention, which are within the spirit of the disclosure or equivalent to the inventions found in the appended claims, it is the intent that this patent will cover those variations as well. The present invention shall only be limited by what is claimed.

EXAMPLE

Figure 4:
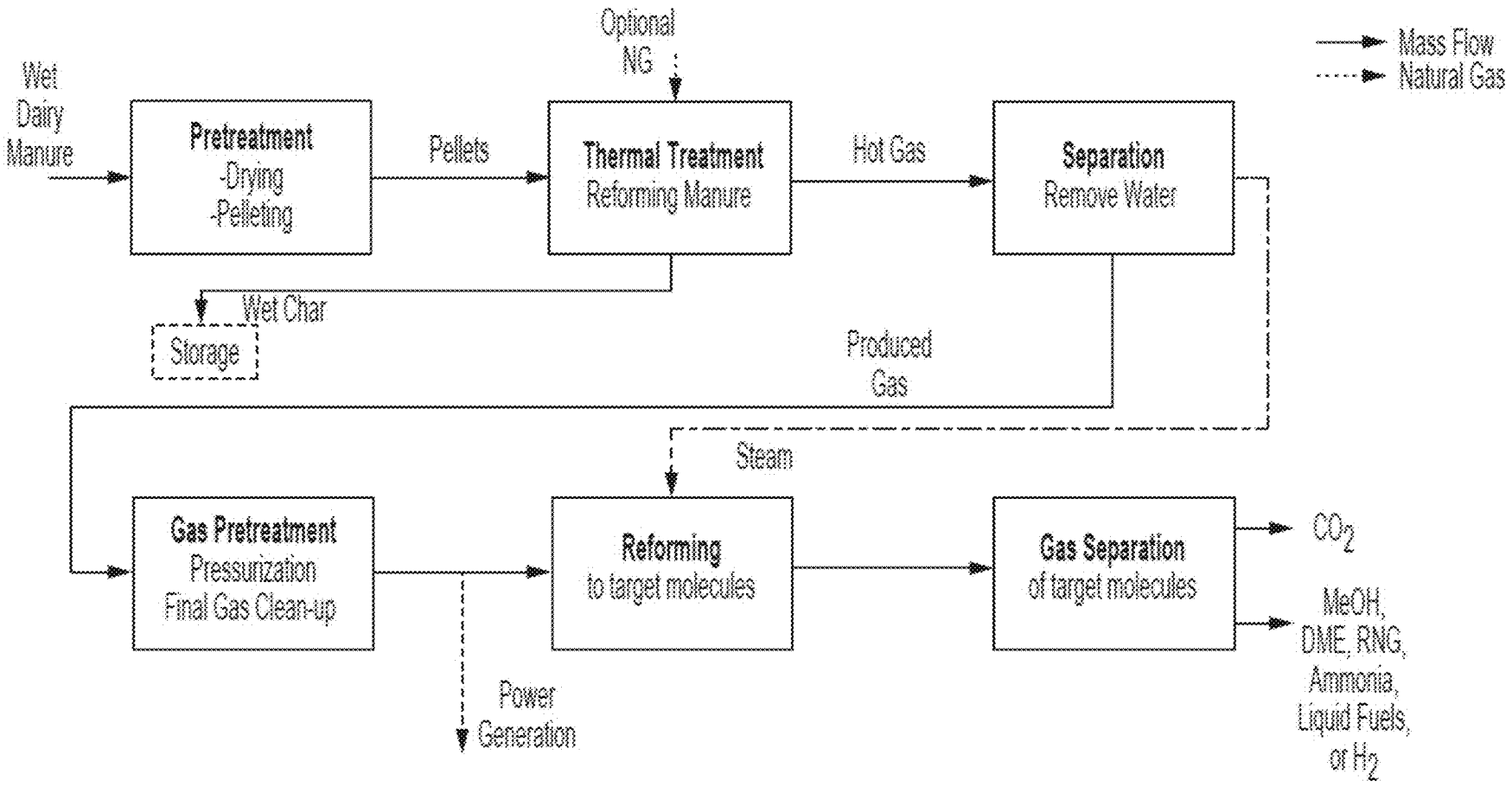
FIG. 4 is a process block-flow diagram for the Example, showing a process designed to convert wet dairy manure into solid biochar and one or more of electrical power, thermal gas, $H_2$, $CO_2$, methanol, dimethyl ether, ammonia, and liquid fuels.

This Example provides a process and system for converting wet dairy manure into solid biochar and one or more of electrical power, thermal gas, $H_2$, $CO_2$, methanol, dimethyl ether, ammonia, and liquid fuels. FIG. 4 is a process block-flow diagram for the Example process as well as system configured to carry out the process.

The goal of the Example process in FIG. 4 is to convert wet dairy manure to a valuable thermal gas, a solid biochar product, and carbon dioxide. The thermal gas can contain $H_2$ and/or CO, and if desired can be converted to methane, methanol, ethanol, dimethyl ether, and/or various liquid fuels such as renewable gasoline, renewable diesel fuel, or renewable jet fuel.

The front end of the process of FIG. 4 receives wet manure at 30 wt % to 85 wt % (typically about 50 wt %)

moisture or greater. The animal manure undergoes an initial pretreatment step of drying at or about atmospheric pressure and at temperatures between 50° C. and 350° C., typically between to 80° C. to 200° C. The moisture of the dried manure is between 15 wt % and 40 wt % (typically about 20 wt %).

A second pretreatment step involves the reshaping of the dried manure to pellets between ⅛ inch to 1 inch in diameter and ranging in length from ⅛ inch to 6 inches. The moisture of the manure pellet is between 0 wt % and 15 wt % (typically about 12 wt %).

After pretreatment, the reshaped manure then is conveyed to the thermal reactor. The thermal reactor processes the reshaped manure between 600° C. and 1200° C., for 5 to 45 minutes. The thermal reactor is heated from external combustion of gas consisting of natural gas, thermal gas, or light gas. The thermal reactor may optionally receive a small amount of oxygen during processing, for internal heat generation via combustion. The pressure in the thermal reactor is at or near atmospheric. Although an external catalyst is not typically added to the thermal reactor, metal oxides present in the starting manure may have a catalytic effect in producing CO and/or $H_2$ in the reactor. Manure may contain $SiO_2$, CaO, $Al_2O_3$, $K_2O$, $P_2O_5$, $Fe_2O_3$, MgO, and $Na_2O$, for example. The thermal reactor produces a solid biochar and an impure wet thermal gas.

Figure 5:
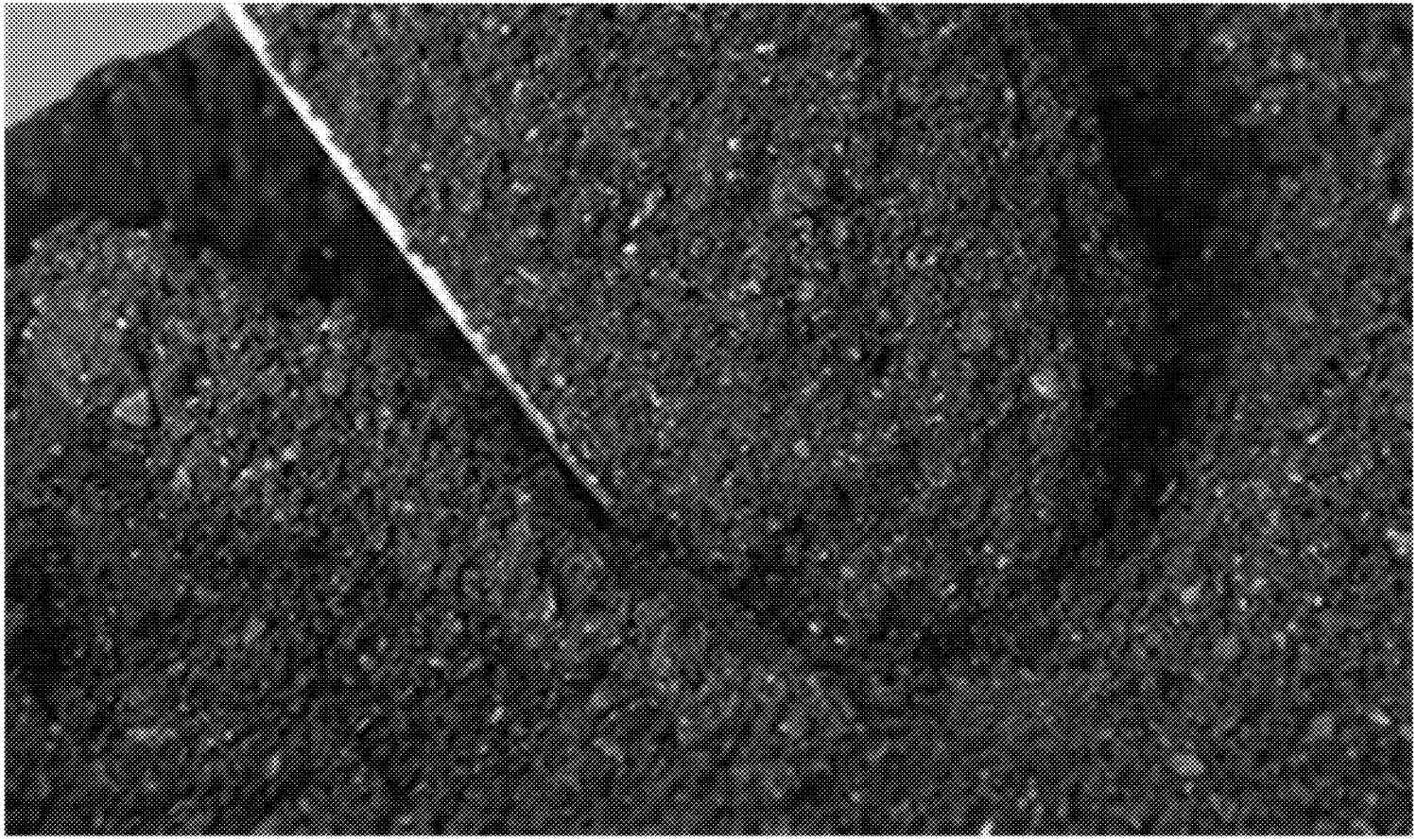
FIG. 5 is a photograph of solid biochar produced in the Example.

The bulk (wet) biochar is separated by gravity from the thermal reactor. Optionally, a fine biochar is cyclonically separated from the wet thermal gas stream. The fine char may alternatively or as an additional treatment be separated via electrostatic precipitation. The bulk biochar and the optional fine biochar may be combined and cooled down to about 20-50° C. by direct or indirect contact with water. Alternatively, the bulk biochar and the optional fine biochar may be cooled using a non-reacting gas, such as nitrogen. The cooled solid biochar is stored prior to further use. In FIG. 4, the cooled solid biochar is labeled "wet char" entering optional storage. FIG. 5 is a photograph of the cooled solid biochar.

The wet thermal gas exits the thermal reactor and undergoes hot cyclonic separation treatment to remove the aforementioned fine biochar. The wet thermal gas optionally undergoes high-temperature reforming to remove unwanted tars that may be contained in the thermal gas. Tars may include phenols, cresols, furans, or polycyclic aromatic hydrocarbons, for example. Thermal tar destruction typically requires 1300° C. or greater using external heat, and optionally with the addition of some oxygen to internally generate heat. A tar-reforming catalyst may be used. In some embodiments, thermal operating conditions are selected to produce a thermal gas with virtually no tars.

After the optional high-temperature reforming, the hot gas continues to the condensation and gas-liquid separation step where the wet thermal gas is cooled to condense and then remove liquids to about 20-50° C. while transferring heat indirectly to liquid water to generate steam.

The condensed liquid is optionally further treated or separated, such as to recover water or other liquids (such as alkanes, acids, or alcohols) if present.

The dry, cooled thermal gas then continues for additional gas processing. The dried thermal gas is compressed to 100 to 800 psig, using one or more compressors.

The compressed thermal gas undergoes reforming utilizing a water-gas shift (WGS) reactor to effectively convert CO and added steam to additional $H_2$ and $CO_2$. The water-gas shift may be either sweet (no sulfur) or sour (with sulfur). The goal of the WGS reactor is to produce the desired thermal gas with a specific composition with respect to $H_2$, CO, and $CO_2$ that is dependent on the final product desired. If $H_2$ is the desired product, then the CO is preferably minimized while $H_2$ is preferably maximized.

After the WGS reactor, the thermal gas stream undergoes acid-gas removal utilizing commonly available technology such as membranes, solvent absorption, or a scrubber to remove a targeted amount of $CO_2$ as well as sulfur if present. The temperatures and pressures of the acid-gas separation will largely be dependent on the technology selected. The $CO_2$ from acid-gas removal may be compressed for export from the facility, such as from 100 psig to 1000 psig.

The thermal gas may be treated in a water knockout unit to remove some or all water. All water separated during the process preferably undergoes standard water treatment for undesired components present in the water.

The thermal gas may then continue to a gas separation step to remove the target gas ($H_2$/CO) from the remaining light gases. The remaining light gases are optionally sent to the front-end burner for heat production.

The target thermal gas typically undergoes compression to a desire pressure ranging between 100 psig (6.9 bar) and 10,000 psig (689 bar). In some cases, the desired product can be cooled and/or compressed to the liquid state.

The purified thermal gas may undergo catalytic reactions to produce a specific compound, such as methane, methanol, dimethyl ether, ethanol, gasoline, diesel fuel, jet fuel, Fischer-Tropsch waxes, and so on. The purified thermal gas may be combusted to produce thermal energy. The purified thermal gas may be fed to a power generator to produce electrical energy.

The cooled solid biochar has the following composition (ultimate analysis):

58.1 wt % carbon
38.5 wt % ash
1.35 wt % nitrogen
1.25 wt % oxygen
0.29 wt % hydrogen
0.25 wt % sulfur
0.30 wt % water The cooled solid biochar (FIG. 5) was combined with polypropylene to produce a biochar-polypropylene composite. The biochar-polypropylene composite contained about 2 wt % biochar. A control composite was produced as well. The control carbon black-polypropylene composite contained about 2 wt % carbon black. In the control composite, the carbon black was commercially available N774 carbon black.

The melt flow rate, impact strength resistance, specific gravity, and stress at fracture were measured for the biochar-polypropylene composites with 2 wt % biochar, compared to the carbon black-polypropylene composites with 2 wt % carbon black. The biochar-polypropylene composite flows slightly better than the carbon black-polypropylene composite. The biochar-polypropylene composite and the carbon black-polypropylene composite have similar viscosity based on melt index. The biochar-polypropylene composite and the carbon black-polypropylene composite have similar tensile stress at break. The biochar-polypropylene composite and the carbon black-polypropylene composite have similar tensile stress at yield. The biochar-polypropylene composite has higher elongation strain at break, compared to the carbon black-polypropylene composite. The biochar-polypropylene composite has higher elongation strain at yield, compared to the carbon black-polypropylene composite. The biochar-polypropylene composite has higher impact resistance, compared to the carbon black-polypropylene composite. After 250 hours of aging, both the biochar-polypropylene composite and the carbon black-polypropylene composite show little change in black color.

Separately, the cooled solid biochar (FIG. 5) was combined with polypropylene to produce another biochar-polypropylene composite. The biochar-polypropylene composite contained about 17 wt % biochar. A control composite was produced as well, using calcium carbonate ($CaCO_3$) rather than biochar. The control composite was a calcium carbonate-polypropylene composite with about 17 wt % calcium carbonate. In the control composite, the calcium carbonate was commercially available Hubercarb Q 325 calcium carbonate.

The biochar-polypropylene composite had higher tensile strength at break than the calcium carbonate-polypropylene composite. The biochar-polypropylene composite had slightly higher tensile strength at yield than the calcium carbonate-polypropylene composite. The biochar-polypropylene composite had slightly higher strain at yield than the calcium carbonate-polypropylene composite. The biochar-polypropylene composite had higher impact resistance than the calcium carbonate-polypropylene composite. After 250 hours of aging, the biochar-polypropylene composite had an increase in stress at yield, compared to the calcium carbonate-polypropylene composite. After 250 hours of aging, none of the composites exhibited a color change.

What is claimed is:

1. A process for converting animal manure into a purified thermal gas, said process comprising:

(a) providing starting animal manure, wherein said starting animal manure has an average moisture content from about 30 wt % to about 90 wt % $H_2O$;

(b) drying said animal manure in a manure dryer operated at a drying temperature selected from about 50° C. to about 350° C. to generate a dried animal manure, wherein said dried animal manure has an average moisture content from about 15 wt % to about 40 wt % $H_2O$;

(c) pelletizing said dried animal manure in a manure pelletizer to generate manure pellets, wherein said manure pellets have an average moisture content from 0 wt % to about 20 wt % $H_2O$;

(d) thermally reacting said manure pellets in a thermal reactor operated at a reaction temperature selected from about 600° C. to about 1500° C., to generate an intermediate thermal gas and a solid biochar from said manure pellets, wherein said intermediate thermal gas contains at least $H_2$, CO, $CO_2$, $CH_4$, and $H_2O$, and wherein said solid biochar contains at least carbon and ash;

(e) separating said solid biochar from said intermediate thermal gas;

(f) optionally, feeding said intermediate thermal gas to a tar-reforming reactor operated at a tar-reforming temperature selected from about 1200° C. to about 1600° C.;

(g) feeding said intermediate thermal gas to a condensing unit, to generate a cooled thermal gas and a separated liquid stream;

(h) compressing said cooled thermal gas using a compression unit, to generate a compressed thermal gas, wherein said compressed thermal gas is at a pressure from about 5 bar to about 55 bar;

(i) catalytically reacting said compressed thermal gas in a water-gas shift reactor operated at a water-gas shift temperature selected from about 200° C. to about 550° C., to generate a shifted thermal gas having an adjusted $H_2$/CO ratio compared to a $H_2$/CO ratio of said compressed thermal gas;

(j) treating said shifted thermal gas using an acid-gas removal unit operated to remove at least a portion of carbon dioxide as well as at least a portion of sulfur-containing compounds from said shifted thermal gas, to generate a purified thermal gas;

(k) optionally, removing water and/or light gases from said purified thermal gas; and (l) recovering or further processing said purified thermal gas.

2. The process of claim 1, wherein said starting animal manure has an average moisture content from about 40 wt % to about 60 wt % $H_2O$.

3. The process of claim 1, wherein said dried animal manure has an average moisture content from about 15 wt % to about 25 wt % $H_2O$.

4. The process of claim 1, wherein said drying temperature is selected from about 80° C. to about 200° C.

5. The process of claim 1, wherein said manure pelletizer is selected from the group consisting of a single-screw extruder, a double-screw extruder, a granulation unit, and combinations thereof.

6. The process of claim 1, wherein said manure pellets have an average moisture content from about 5 wt % to about 15 wt % $H_2O$.

7. The process of claim 1, wherein said manure pellets have an average effective length from about 3 millimeters to about 150 millimeters.

8. The process of claim 1, wherein said manure pellets have an average effective diameter from about 3 millimeters to about 25 millimeters.

9. The process of claim 1, wherein step (d) includes introducing a sub-stoichiometric quantity of oxygen into said thermal reactor.

10. The process of claim 1, wherein step (e) includes removing said solid biochar by gravity directly from said thermal reactor.

11. The process of claim 1, wherein step (e) includes removing said solid biochar from said intermediate thermal gas downstream of said thermal reactor.

12. The process of claim 11, wherein step (e) includes using a cyclone and/or an electrostatic precipitator to remove fine particles of said solid biochar from said intermediate thermal gas.

13. The process of claim 1, wherein step (f) is performed.

14. The process of claim 1, wherein said water-gas shift temperature is selected from about 300° C. to about 450° C.

15. The process of claim 1, wherein said water-gas shift temperature is selected from about 200° C. to about 300° C.

16. The process of claim 1, wherein said water-gas shift reactor comprises a high-temperature-shift reaction zone and a low-temperature-shift reaction zone.

17. The process of claim 16, wherein said high-temperature-shift reaction zone is operated at a temperature selected from about 300° C. to about 450° C., and wherein said low-temperature-shift reaction zone is operated at a temperature selected from about 200° C. to about 300° C.

18. The process of claim 1, wherein said adjusted $H_2$/CO ratio of said shifted thermal gas is selected from about 0.5 to about 5.0.

19. The process of claim 1, wherein said adjusted $H_2$/CO ratio of said shifted thermal gas is selected from about 1.0 to about 3.0.

20. The process of claim 1, wherein said acid-gas removal unit is selected from the group consisting of a membrane unit, a solvent absorption unit, a scrubber, a refrigeration unit, and combinations thereof.

21. The process of claim 1, wherein said sulfur-containing compounds are selected from the group consisting of $H_2S$, COS, $SO_2$, elemental sulfur, and combinations thereof.

22. The process of claim 1, wherein step (k) is performed.

23. The process of claim 22, wherein a water knockout unit is utilized to remove said water from said purified thermal gas, and/or wherein a gas-separation unit is utilized to remove said light gases from said purified thermal gas.

24. The process of claim 1, wherein said purified thermal gas is recovered and stored or shipped.

25. The process of claim 1, wherein said purified thermal gas is further catalytically converted into a product selected from the group consisting of methane, methanol, dimethyl ether, ethanol, diethyl ether, acetic acid, acetaldehyde, ethylene, propylene, Fischer-Tropsch liquids, Fischer-Tropsch waxes, gasoline, diesel fuel, jet fuel, and combinations thereof.

26. The process of claim 1, wherein said purified thermal gas is combusted to produce thermal energy.

27. The process of claim 1, wherein said purified thermal gas is combusted to produce electrical energy.

28. The process of claim 1, wherein said purified thermal gas is further processed to produce a hydrogen product.

29. The process of claim 1, wherein said solid biochar is recovered as a biochar co-product.

30. The process of claim 1, wherein said solid biochar is combined with another material to form a composite material comprising said solid biochar.

* * * * *